US007926597B2

(12) United States Patent
Majagi et al.

(10) Patent No.: US 7,926,597 B2
(45) Date of Patent: Apr. 19, 2011

(54) FIXED CUTTER BIT AND BLADE FOR A FIXED CUTTER BIT AND METHODS FOR MAKING THE SAME

(75) Inventors: Shivanand I. Majagi, Rogers, AR (US); Jonathan W. Bitler, Fayetteville, AR (US)

(73) Assignee: Kennametal Inc., Latrobe, PA (US)

( * ) Notice: Subject to any disclaimer, the term of this patent is extended or adjusted under 35 U.S.C. 154(b) by 198 days.

(21) Appl. No.: 11/804,779

(22) Filed: May 21, 2007

(65) Prior Publication Data

US 2008/0289880 A1 Nov. 27, 2008

(51) Int. Cl.
*E21B 10/00* (2006.01)

(52) U.S. Cl. ..... 175/435; 175/412; 175/413

(58) Field of Classification Search ..... 175/413, 175/412, 425, 435
See application file for complete search history.

(56) References Cited

U.S. PATENT DOCUMENTS 4,200,159 A * 4/1980 Peschel et al. ..... 175/428
4,834,963 A 5/1989 Terry et al.
5,038,859 A * 8/1991 Lynde et al. ..... 166/55.6
5,551,522 A 9/1996 Keith et al.
6,164,394 A 12/2000 Mensa-Wilmot et al.
6,308,790 B1 10/2001 Mensa-Wilmot et al.
6,344,149 B1 * 2/2002 Oles ..... 216/11
6,564,886 B1 5/2003 Mensa-Wilmot et al.
6,615,934 B2 9/2003 Mensa-Wilmot
6,651,756 B1 11/2003 Costo, Jr. et al.
6,984,454 B2 1/2006 Majagi
7,096,978 B2 8/2006 Dykstra et al.
7,128,773 B2 10/2006 Liang et al.
2005/0133272 A1 6/2005 Huang et al.
2005/0247491 A1 11/2005 Mirchandani et al.
2006/0185908 A1 * 8/2006 Kembaiyan et al. ..... 175/425
2008/0042484 A1 * 2/2008 Majagi et al. ..... 299/111

OTHER PUBLICATIONS

Santhanam, A. T. et al, "Cemented Carbides" Metals Handbook, The Materials Information Society, pp. 950-978.

* cited by examiner

*Primary Examiner* — Kenneth Thompson
*Assistant Examiner* — Cathleen R Hutchins
(74) *Attorney, Agent, or Firm* — Matthew W. Smith

(57) ABSTRACT

A blade, which is useful on a tool that impinges earth strata, that has a blade body with a leading surface. The blade body has a first portion defining at least a part of the leading surface and a second portion. The first portion is made of a first material composition and the second portion is made of a second material composition.

10 Claims, 18 Drawing Sheets

FIXED CUTTER BIT AND BLADE FOR A FIXED CUTTER BIT AND METHODS FOR MAKING THE SAME

BACKGROUND OF THE INVENTION

The invention pertains to a fixed cutter bit, as well as a blade for a fixed cutter bit, and the methods for making the same, that is useful in drilling boreholes in subterranean formations such as is common in oil and gas exploration. More specifically, the invention pertains to a fixed cutter bit, as well as a blade for a fixed cutter bit, and the methods for making the same, that is useful in drilling boreholes in subterranean formations wherein the fixed cutter bit contains blades that exhibit improved wear resistance and toughness.

Earth-boring bits may have fixed or rotatable cutting elements. Earth-boring bits with fixed cutting elements typically include a bit body machined from steel or fabricated by infiltrating a bed of hard particles, such as cast carbide (WC+W2C), tungsten carbide (WC), and/or sintered cemented carbide with a binder such as, for example, a copper-base alloy. Several cutting inserts are fixed to the bit body in predetermined positions to optimize cutting. The bit body may be secured to a steel shank that typically includes a threaded pin connection by which the bit is secured to a drive shaft of a downhole motor or a drill collar at the distal end of a drill string.

Steel bodied bits are typically machined from round stock to a desired shape, with topographical and internal features. Hard-facing techniques may be used to apply wear-resistant materials to the face of the bit body and other critical areas of the surface of the bit body.

In the conventional method for manufacturing a bit body from hard particles and a binder, a mold is milled or machined to define the exterior surface features of the bit body. Additional hand milling or clay work may also be required to create or refine topographical features of the bit body.

Once the mold is complete, a preformed bit blank of steel may be disposed within the mold cavity to internally reinforce the bit body and provide a pin attachment matrix upon fabrication. Other sand, graphite, transition or refractory metal based inserts, such as those defining internal fluid courses, pockets for cutting elements, ridges, lands, nozzle displacements, junk slots, or other internal or topographical features of the bit body, may also be inserted into the cavity of the mold. Any inserts used must be placed at precise locations to ensure proper positioning of cutting elements, nozzles, junk slots, etc. in the final bit.

The desired hard particles may then be placed within the mold and packed to the desired density. The hard particles are then infiltrated with a molten binder, which freezes to form a solid bit body including a discontinuous phase of hard particles within a continuous phase of binder.

The bit body may then be assembled with other earth-boring bit components. For example, a threaded shank may be welded or otherwise secured to the bit body, and cutting elements or inserts (typically cemented tungsten carbide, or diamond or a synthetic polycrystalline diamond member ("PDC")) are secured within the cutting insert pockets, such as by brazing, adhesive bonding, or mechanical affixation. Alternatively, the cutting inserts may be bonded to the face of the bit body during furnacing and infiltration if thermally stable PDC's ("TSP" (thermally stable polycrystalline diamond)) are employed.

Fixed cutter bits have been used in drilling boreholes in subterranean formations such as is common in oil and gas exploration. United States Patent Application Publication No. US2005/0133272 to Huang et al., U.S. Patent Application Publication No. US2005/0247491 to Mirchandani et al., U.S. Pat. No. 6,615,934 to Mensa-Wilmot, and U.S. Pat. No. 7,096,978 to Dykstra et al. show exemplary fixed cutter bits, and these patent documents are hereby incorporated by reference herein. One typical kind of fixed cutter bit includes blades that extend or project from the main body of the cutter bit. The blades typically carry a plurality of cutter elements wherein the cutter elements impinge the earth formation during the drilling operation.

Earth-boring bits typically are secured to the terminal end of a drill string, which is rotated from the surface or by mud motors located just above the bit on the drill string. Drilling fluid or mud is pumped down the hollow drill string and out nozzles formed in the bit body. The drilling fluid or mud cools and lubricates the bit as it rotates and also carries material cut by the bit to the surface.

The bit body and other elements of earth-boring bits are subjected to many forms of wear as they operate in the harsh down hole environment. Among the most common form of wear is abrasive wear caused by contact with abrasive rock formations. In addition, the drilling mud, laden with rock cuttings, causes erosive wear on the bit.

The service life of an earth-boring bit is a function not only of the wear properties of the PDCs or cemented carbide inserts, but also of the wear properties of the bit body (in the case of fixed cutter bits) or cones (in the case of roller cone bits). One way to increase earth-boring bit service life is to employ bit bodies or cones made of materials with improved combinations of strength, toughness, and abrasion/erosion resistance.

Since the blades that carry the cutter elements experience (or can experience) a significant amount of abrasive wear during the drilling operation due to the abrasive nature of a typical earth formation. Thus, it would be highly desirable to provide a fixed cutter bit, as well as a method for making such a fixed cutter bit, that is useful in drilling boreholes in subterranean formations wherein the fixed cutter bit contains blades that exhibit improved wear resistance, and this is especially the case with respect to the leading edge or region of the blade.

Since the blades that carry the cutter elements experience (or can experience) a significant amount of impact during the drilling operation due to the inconsistent nature of a typical earth formation in that it contains hard inclusions (e.g., rock). Thus, it would be highly desirable to provide a fixed cutter bit, as well as a method for making such a fixed cutter bit, that is useful in drilling boreholes in subterranean formations wherein the fixed cutter bit contains blades that exhibit improved impact resistance.

Fluid emitted from the nozzles in the bit body can directly impinge upon the cutter bit body including impingement upon the blades that carry the cutter elements. During the drilling operation, the blades, which carry the cutter elements, experience (or can experience) a significant amount of erosive wear. This erosive wear can be due to the impingement of the fluid, as well as the abrasive nature of a typical earth formation. Thus, it would be highly desirable to provide a fixed cutter bit, as well as a method for making such a fixed cutter bit, that is useful in drilling boreholes in subterranean formations wherein the fixed cutter bit contains blades that exhibit improved erosive wear resistance.

SUMMARY OF THE INVENTION

In one form thereof, the invention is a blade for use on a tool that impinges earth strata. The blade comprises a blade body that has a leading surface. The blade body has a first portion that defines at least a part of the leading surface. The blade body further has a second portion. The first portion comprises a first material composition and the second portion comprises a second material composition.

In another form thereof, the invention is a blade for use on a fixed cutter bit. The blade comprises a blade body that has a leading portion, optionally a mediate portion and a trailing portion. The leading portion contains at least one groove for receiving a cutter element. The leading portion is made from a leading portion material, the mediate portion being made from a mediate portion material, and the trailing portion being made from a trailing portion material.

In still another form thereof, the invention is a fixed cutter bit that has a bit body that presents a shoulder wherein a blade projects from the shoulder. The blade comprises a blade body that has a leading surface. The blade body has a first portion defining at least a part of the leading surface, and the blade body further has a second portion. The first portion comprises a first material composition and the second portion comprises a second material composition. The first material composition material is selected from the group consisting of cemented carbide and steel and a hard composite comprising a plurality of hard constituents and matrix powder of hard particles and an infiltrant alloy bonded together to form the hard composite. The second material composition material is selected from the group consisting of cemented carbide and steel and a hard composite comprising a plurality of hard constituents and matrix powder of hard particles and an infiltrant alloy bonded together to form the hard composite.

In yet another form thereof, the invention is a fixed cutter bit for impinging earth strata. The fixed cutter bit comprises a bit body that has a first portion of a first hardness and a plurality of blades projecting from the bit body wherein each one of the blades comprises a blade body and at least one cutter element carried by the blade body. Each one of the blade bodies has a portion of a second hardness greater than the first hardness.

BRIEF DESCRIPTION OF THE DRAWINGS

The following is a brief description of the drawings.

DETAILED DESCRIPTION

Figure 1:
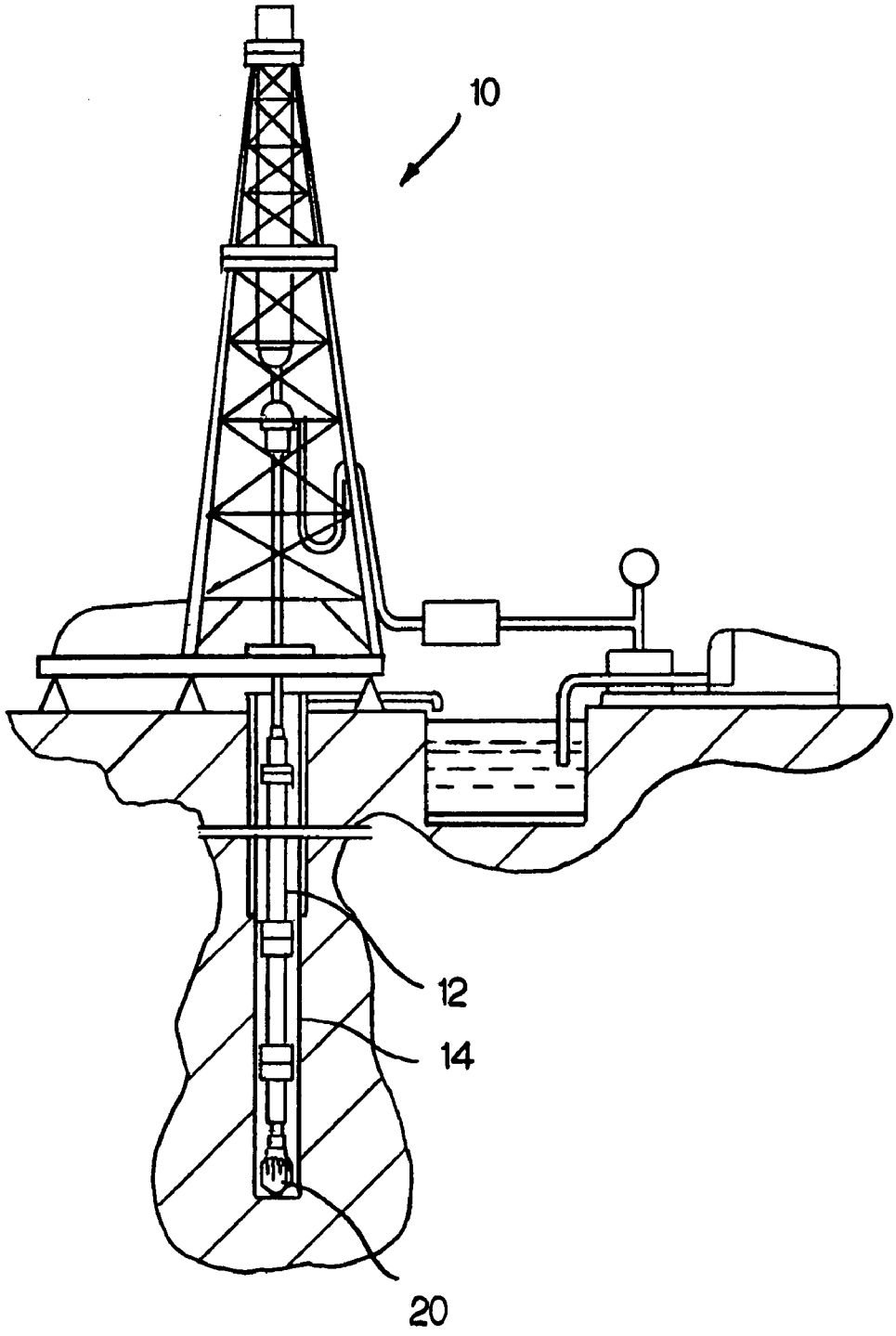
FIG. 1 is a schematic view of a drilling system for drilling boreholes in subsurface earth formations.

Referring to the drawings, FIG. 1 shows a drilling system for drilling boreholes in subsurface earth formations. This drilling system includes a drilling rig 10 used to turn a drill string 12 which extends downward into a well bore 14. Connected to the end of the drill string 12 is a fixed cutter bit generally designated as 20. In this embodiment, the fixed cutter bit 20 is a polycrystalline diamond member (PDC) style of fixed cutter bit. It is within the scope of the invention to encompass other styles of fixed cutter bits. In addition to use in connection with drilling boreholes in subsurface earth formations, it is further within the scope of the invention to encompass other kinds of blades, which may or may not carry cutter elements, used on tools (e.g., drums, wheels, holders and the like) useful in operations that impinge earth strata. These operations may include without limitation mining applications wherein the blades may be affixed to a mining drum or holders on a mining drum, road planing wherein the blades may be affixed to a road planing drum or holders on a road planing drum, concrete cutting wherein the blades may be affixed to a cutting wheel or holders on a cutting wheel and the like.

Figure 2:
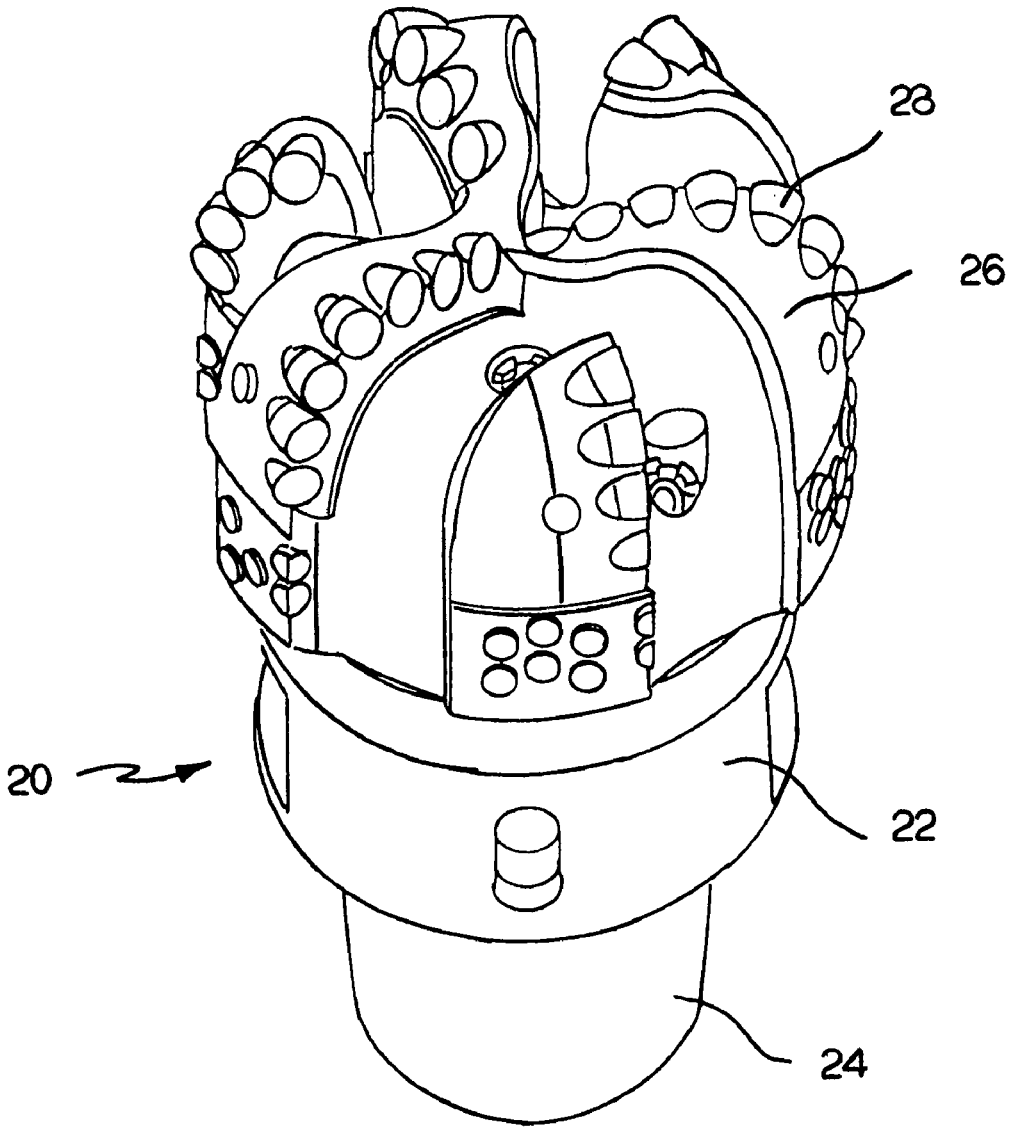
FIG. 2 is an isometric view of a specific embodiment of a fixed cutter bit carrying polycrystalline diamond member (PDC) cutter elements.

As illustrated in FIG. 2, a fixed cutter bit (or fixed cutter drill bit) 20 (such as, for example, a PDC (polycrystalline diamond) drill bit) typically includes a bit body 22 having an externally threaded connection at one end 24, and a plurality of blades 26 extending from the other end of bit body 22 and forming the cutting surface of the bit 20. A plurality of PDC cutters (or cutter elements) 28 are attached to each of the blades 26 via the grooves (not illustrated) and extend from the blades to cut through earth formations when the bit 20 is rotated during drilling. The cutters 28 deform the earth formation by scraping and shearing. In this embodiment, the cutter 28 are polycrystalline diamond members; however, it is contemplated that the cutters 28 may also comprise tungsten carbide inserts, milled steel teeth, or any other cutting elements of materials hard and strong enough to deform or cut through the formation or engage the earth strata in earth strata impinging operations such as, for example, drilling, mining, road planing and cutting such as concrete cutting.

The bit body 22 presents at least a portion thereof that is of a first hardness. The blades have at least a portion thereof that is of a second hardness. The second hardness of the portion of the blade is greater than the first hardness of the portion of the bit body.

Figure 2A:
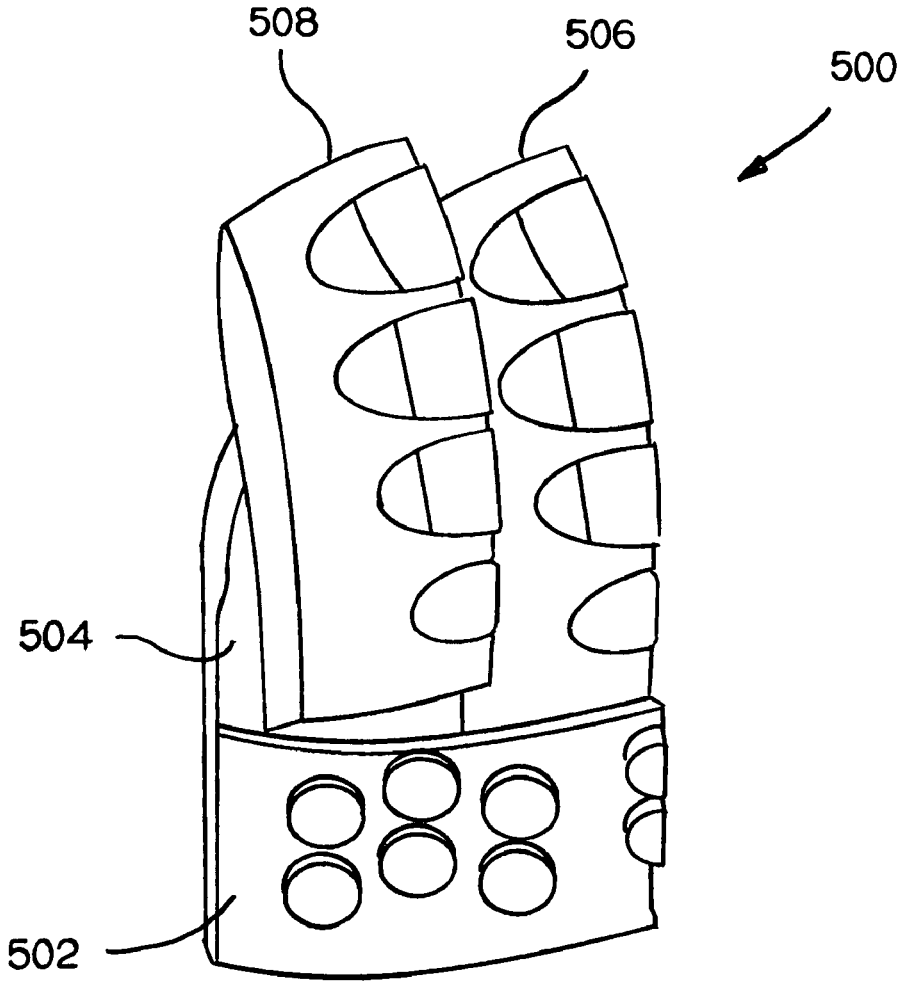
FIG. 2A illustrates a portion of a fixed cutter bit that has a cutter bit body with a shoulder portion from which extend a pair of blades wherein each blade carries cutter elements.

FIG. 2A illustrates a portion of a fixed cutter bit 500 that has a cutter bit body 502 with a shoulder portion 504. A pair of blades 506 and 508 extend from the shoulder portion 504. Thus, it can be appreciated that FIG. 2A shows a plurality of blades 506, 508 that project from a single shoulder 504.

FIGS. 3A through 6 illustrate various embodiments of the blades that carry the PCD cutter elements. Due to the many options for the blades, these blades provide a way to accommodate a wide variety of earth formations to enhance the performance of the fixed cuter bit. FIGS. 3A through 4B shows blades that present a leading portion and a trailing portion. Although the specific compositional aspects of the blades will be discussed hereinafter, it is contemplated that the leading portion is made from a first composition of material and the trailing portion is made from a second composition of material. The first and second compositions of material may be of the same kind of material (e.g., cemented (cobalt) tungsten carbide), but with different compositions (e.g., the cobalt contents may be different). In the alternative, the first and second compositions of material may of different kinds (e.g., the first composition of material may be steel and the second composition of material may be cemented carbide).

Figure 3A:
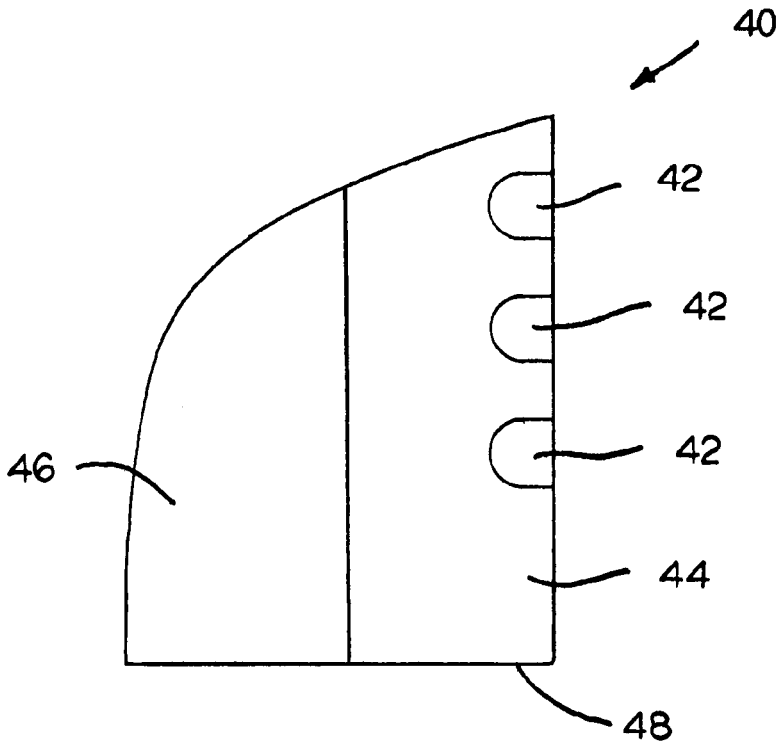
FIG. 3A is a side view of a second embodiment of a single blade from the fixed cutter bit of FIG. 2 with the PDC cutter elements removed from the blade so as to expose the grooves in the blade, and wherein the leading portion of the blade comprises cemented carbide and the trailing portion of the blade comprises steel.

FIG. 3A is a side view of a second embodiment of a single blade 40 from a fixed cutter bit along the lines of FIG. 2 with the PDC cutter elements removed from the blade so as to expose the grooves 42 in the blade. The blade 40 comprises a leading portion 44 and a trailing portion 46 joined to the leading portion 44.

In this specific embodiment, the leading portion 44 of the blade 40 comprises cemented carbide (e.g., cemented (cobalt) tungsten carbide) and the trailing portion 46 of the blade 40 comprises steel. The leading portion 44 and trailing portion 46 can be joined together by any one of a number of techniques including without limitation brazing techniques and infiltration techniques. Although it will be discussed in more detail hereinafter, the blade 40 is joined at the radial inward edge 48 thereto the cutter bit body by any one of a number of techniques including without limitation brazing techniques, infiltration techniques, press fitting techniques, shrink fitting techniques, welding techniques, and mechanical technical techniques (e.g. mechanical fastening). The end result is that the blade is securely affixed to the cutter bit body.

Figure 3B:
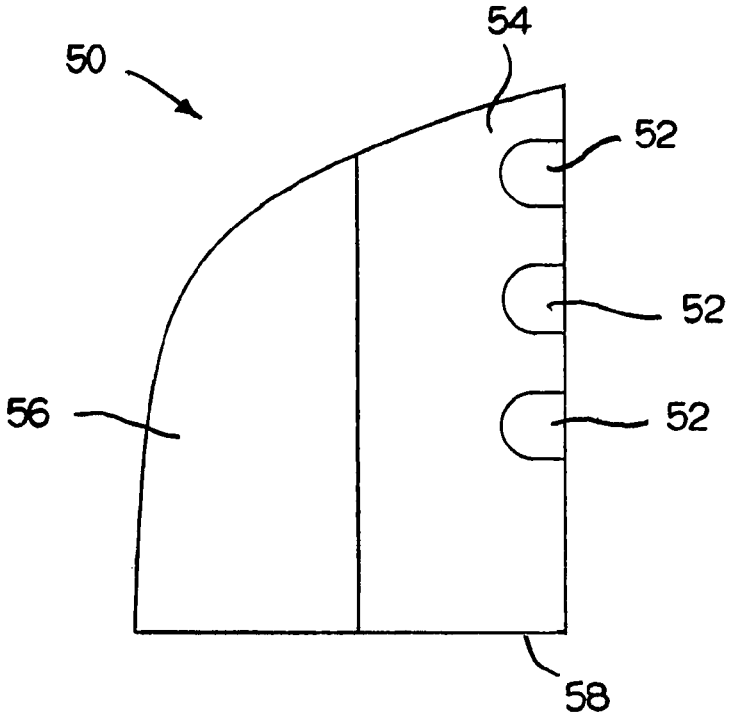
FIG. 3B is a side view of a third embodiment of a single blade from the fixed cutter bit of FIG. 2 with the PDC cutter elements removed from the blade so as to expose the grooves in the blade, and wherein the leading portion of the blade comprises steel and the trailing portion of the blade comprises cemented carbide.

FIG. 3B is a side view of a third embodiment of a single blade 50 from a fixed cutter bit along the lines of FIG. 2 with the PDC cutter elements removed from the blade so as to expose the grooves 52 in the blade 50. The blade 50 has a leading portion 54 and a trailing portion 56 that are joined together. The leading portion 54 of the blade 50 comprises steel. The trailing portion 56 of the blade 50 comprises cemented carbide (e.g., cemented (cobalt) tungsten carbide). The leading portion 54 and trailing portion 56 can be joined together by any one of a number of techniques including without limitation brazing techniques and infiltration techniques. Although it will be discussed in more detail hereinafter, the blade 50 is joined at the radial inward edge 58 thereto the cutter bit body by any one of a number of techniques including without limitation brazing techniques, infiltration techniques, press fitting techniques, shrink fitting techniques, welding techniques, and mechanical technical techniques (e.g. mechanical fastening). The end result is that the blade is securely affixed to the cutter bit body.

Figure 3C:
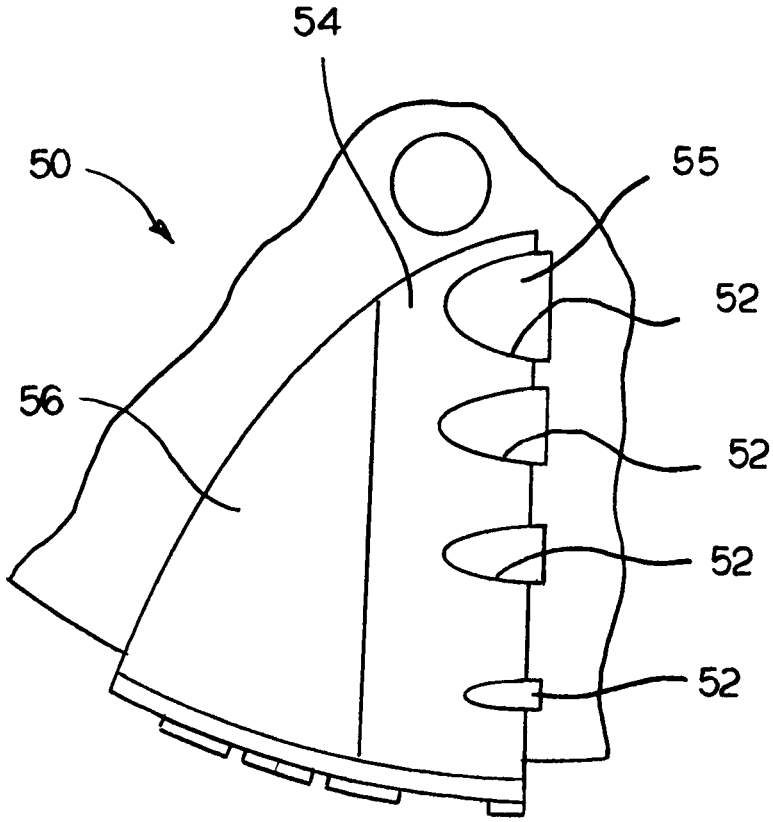
FIG. 3C is a top view of the third embodiment of the single blade of FIG. 3B.

FIG. 3C is a top view of the blade 50 of FIG. 3B wherein the cutter elements 55 are received within the grooves 52. FIG. 3C shows the leading portion 54 and the trailing portion 56 in such a fashion that it is clear that the leading portion is rotational ahead of the trailing portion in that the leading portion first impinges upon the earth strata.

Figure 4A:
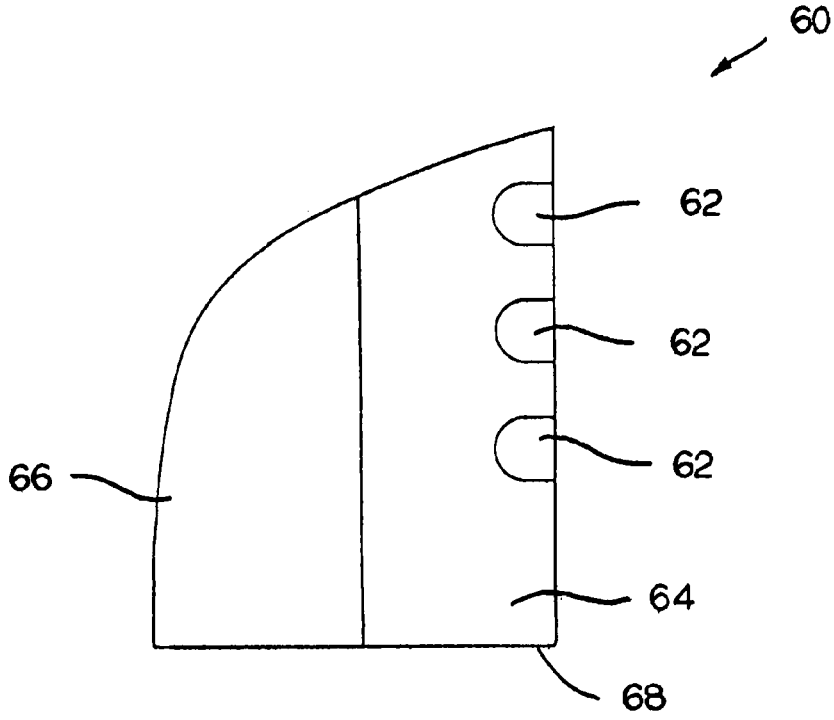
FIG. 4A is a side view of a fourth embodiment of a single blade from the fixed cutter bit of FIG. 2 with the PDC cutter elements removed from the blade so as to expose the grooves in the blade, and wherein the leading portion of the blade comprises cemented carbide and the trailing portion of the blade comprises a hard component-matrix composite material.

FIG. 4A is a side view of a fourth embodiment of a single blade 60 from a fixed cutter bit along the lines of FIG. 2 with the PDC cutter elements removed from the blade 60 so as to expose the grooves 62 in the blade 60. The blade 60 has a leading portion 64 that is joined together with a trailing portion 66. In this embodiment, the leading portion 64 of the blade 60 comprises cemented carbide (e.g., cemented (cobalt) tungsten carbide) and the trailing portion 66 of the blade 60 comprises a hard component-matrix composite material. The hard component-matrix composite material will be described in more detail hereinafter. The leading portion 64 and trailing portion 66 can be joined together by any one of a number of techniques including without limitation brazing techniques and infiltration techniques. Although it will be discussed in more detail hereinafter, the blade 60 is joined at the radial inward edge 68 thereto the cutter bit body by any one of a number of techniques including without limitation brazing techniques, infiltration techniques, press fitting techniques, shrink fitting techniques, welding techniques, and mechanical technical techniques (e.g. mechanical fastening). The end result is that the blade is securely affixed to the cutter bit body.

Figure 4B:
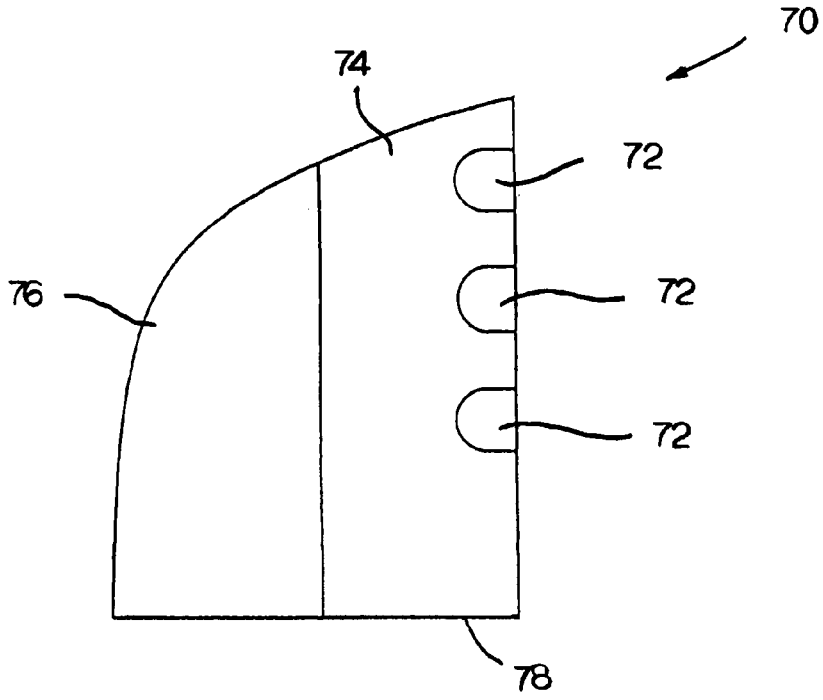
FIG. 4B is a side view of a fifth embodiment of a single blade from the fixed cutter bit of FIG. 2 with the PDC cutter elements removed from the blade so as to expose the grooves in the blade, and wherein the leading portion of the blade comprises a hard component-matrix composite material and the trailing portion of the blade comprises a cemented carbide.

FIG. 4B is a side view of a fifth embodiment of a single blade 70 from a fixed cutter bit along the lines of FIG. 2 with the PDC cutter elements removed from the blade 70 so as to expose the grooves 72 in the blade 70. The blade 70 has a leading portion 74 that is joined to a trailing portion 76. The leading portion 74 of the blade 70 comprises a hard component-matrix composite material and the trailing portion 76 of the blade comprises a cemented carbide. The leading portion 74 and trailing portion 76 can be joined together by any one of a number of techniques including without limitation brazing techniques and infiltration techniques. Although it will be discussed in more detail hereinafter, the blade 70 is joined at the radial inward edge 78 thereto the cutter bit body by any one of a number of techniques including without limitation brazing techniques, infiltration techniques, press fitting techniques, shrink fitting techniques, welding techniques and mechanical technical techniques (e.g. mechanical fastening). The end result is that the blade is securely affixed to the cutter bit body.

It is contemplated that an embodiment of the blade that has only a leading portion and a trailing portion may utilize steel as a material for the portions. In this regard, as one alternative, the leading portion may be made from steel and the trailing portion made from cemented carbide. As another alternative, the leading portion may be made from cemented carbide and the trailing portion made from steel. As yet another alternative, the leading portion may be made from steel and the trailing portion made from the hard component-matrix composite material. As still another alternative, the leading portion may be made from the hard component-matrix composite material and the trailing portion made from steel.

FIGS. 5A through 5F illustrate blades that present a leading portion, a mediate portion and a trailing portion. Although the specific compositional aspects of the blades will be discussed hereinafter, it is contemplated that the leading portion is made from a first composition of material, the trailing portion is made from a second composition of material, and the mediate portion is made from a third composition of material. The first and second and third compositions of material may be of the same kind of material (e.g., cemented (cobalt) tungsten carbide), but with different compositions (e.g., the cobalt contents may be different). In the alternative, the first and second and third compositions of material may of different kinds (e.g., the first composition of material may be steel and the second composition of material may be cemented carbide).

Figure 5A:
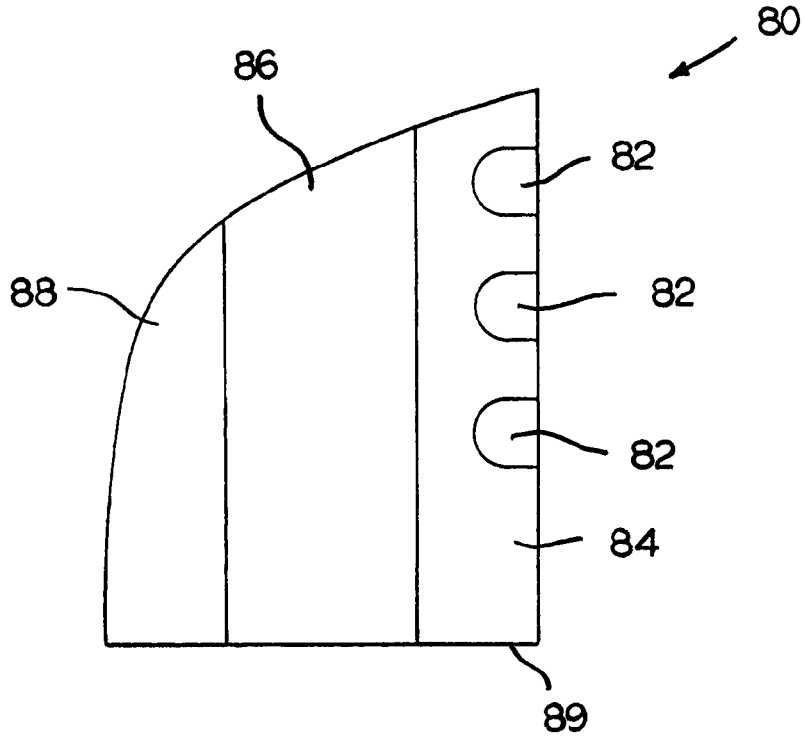
FIG. 5A is a side view of a sixth embodiment of a single blade from the fixed cutter bit of FIG. 2 with the PDC cutter elements removed from the blade so as to expose the grooves in the blade, and the leading portion of the blade comprises cemented carbide, the mediate portion of the blade comprises a hard component-matrix composite material, and the trailing portion of the blade comprises steel.

FIG. 5A is a side view of a sixth embodiment of a single blade 80 from a fixed cutter bit along the lines of FIG. 2 with the PDC cutter elements removed from the blade 80 so as to expose the grooves 82 in the blade 80. The blade 80 comprises a leading portion 84, a mediate portion 86 and a trailing portion 88 wherein these three portions are joined together with the mediate portion 86 sandwiched between the leading and trailing portions.

The leading portion 84 of the blade 80 comprises cemented carbide. The mediate portion 86 of the blade 80 comprises a hard component-matrix composite material. The trailing portion 88 of the blade 80 comprises steel. For this embodiment, the leading portion, the mediate portion and the trailing portion can be joined together by any one of a number of techniques including without limitation brazing techniques and infiltration techniques. Although it will be discussed in more detail hereinafter, the blade 80 is joined at the radial inward edge 89 thereto the cutter bit body by any one of a number of techniques including without limitation brazing techniques, infiltration techniques, press fitting techniques, shrink fitting techniques, welding techniques and mechanical technical techniques (e.g. mechanical fastening). The end result is that the blade is securely affixed to the cutter bit body.

Figure 5B:
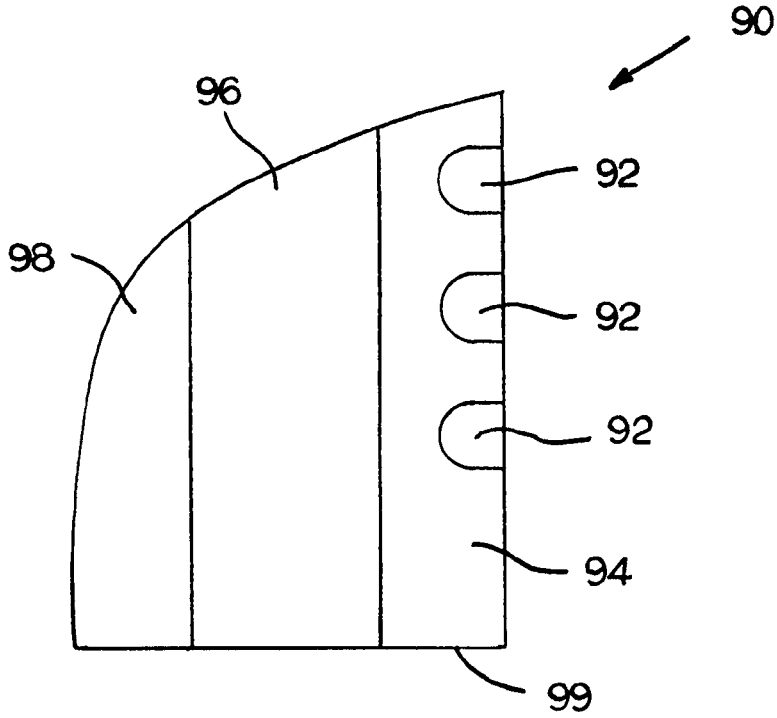
FIG. 5B is a side view of a sixth embodiment of a single blade from the fixed cutter bit of FIG. 2 with the PDC cutter elements removed from the blade so as to expose the grooves in the blade, and wherein the leading portion of the blade comprises cemented carbide, the mediate portion of the blade comprises steel, and the trailing portion of the blade comprises a hard component-matrix composite material.

FIG. 5B is a side view of a sixth embodiment of a single blade 90 from a fixed cutter along the lines of FIG. 2 with the PDC cutter elements removed from the blade 90 so as to expose the grooves 92 in the blade 90. The blade 90 comprises a leading portion 94, a mediate portion 96 and a trailing portion 98 that are joined together with the mediate portion 96 being between the leading and trailing portions. The leading portion 94 of the blade 90 comprises cemented carbide, the mediate portion 96 of the blade 90 comprises steel, and the trailing portion 98 of the blade 90 comprises a hard component-matrix composite material. For this embodiment, the leading portion, the mediate portion and the trailing portion can be joined together by any one of a number of techniques including without limitation brazing techniques and infiltration techniques. Although it will be discussed in more detail hereinafter, the blade 90 is joined at the radial inward edge 99 thereto the cutter bit body by any one of a number of techniques including without limitation brazing techniques, infiltration techniques, press fitting techniques, shrink fitting techniques, welding techniques, and mechanical technical techniques (e.g. mechanical fastening). The end result is that the blade is securely affixed to the cutter bit body.

Figure 5C:
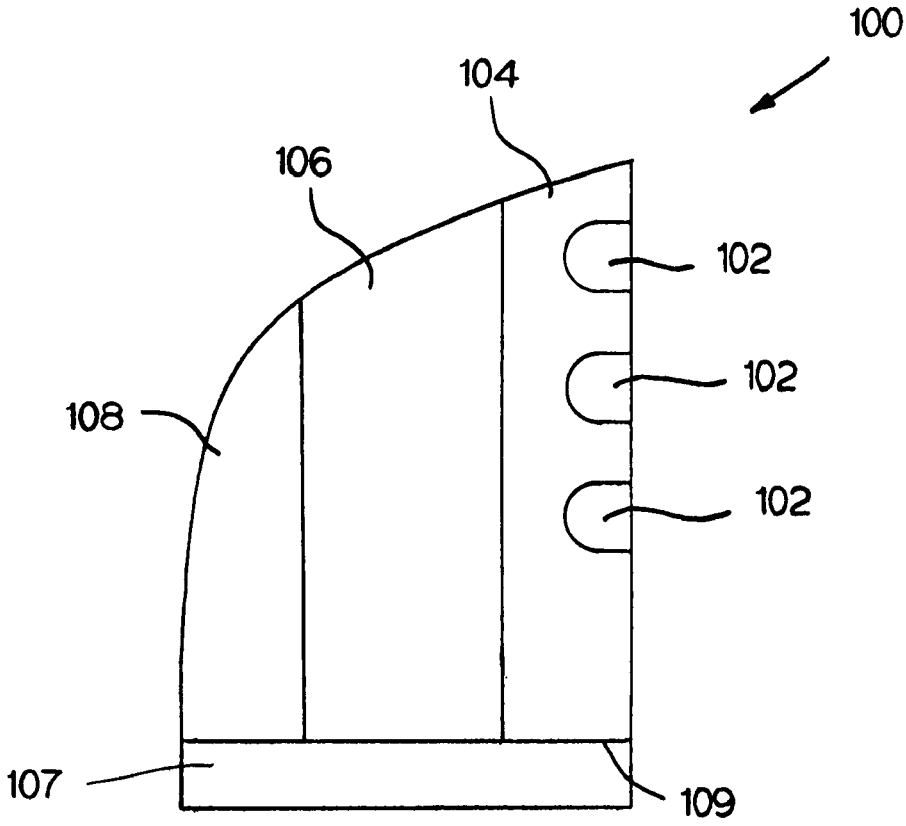
FIG. 5C is a side view of a sixth embodiment of a single blade from the fixed cutter bit of FIG. 2 with the PDC cutter elements removed from the blade so as to expose the grooves in the blade, and wherein the leading portion of the blade comprises a hard component-matrix composite material, the mediate portion of the blade comprises cemented carbide, and the trailing portion of the blade comprises steel, and the bottom (or radial inward) end of the blade has a portion made from infiltrated tungsten metal.

FIG. 5C is a side view of a sixth embodiment of a single blade 100 from a fixed cutter bit along the lines of FIG. 2 with the PDC cutter elements removed from the blade 100 so as to expose the grooves 102 in the blade 100. The blade 100 comprises a leading portion 104, a mediate portion 106 and a trailing portion 108 that are joined together. The leading portion 104 of the blade 100 comprises a hard component-matrix composite material. The mediate portion 106 of the blade 100 comprises cemented carbide. The trailing portion 108 of the blade 100 comprises steel. For this embodiment, the leading portion, the mediate portion and the trailing portion can be joined together by any one of a number of techniques including without limitation brazing techniques and infiltration techniques.

Blade 100 has a radial inward portion 107 at the radial inward edge 109 thereof. The radial inward portion 107 is infiltrated tungsten metal and is particularly useful in facilitating the joinder of the blade 100 to the cutter bit body, especially when techniques that create a metallurgical bond are the bonding techniques. It should be appreciated that any of the other blade structures could include a radial inward portion that comprises infiltrated tungsten metal. It should also be appreciated that blade 100 could be affixed to the cutter bit body by any one of a number of techniques including without limitation brazing techniques, infiltration techniques, press fitting techniques, shrink fitting techniques, welding techniques, and mechanical technical techniques (e.g. mechanical fastening). The end result is that the blade is securely affixed to the cutter bit body.

Figure 5D:
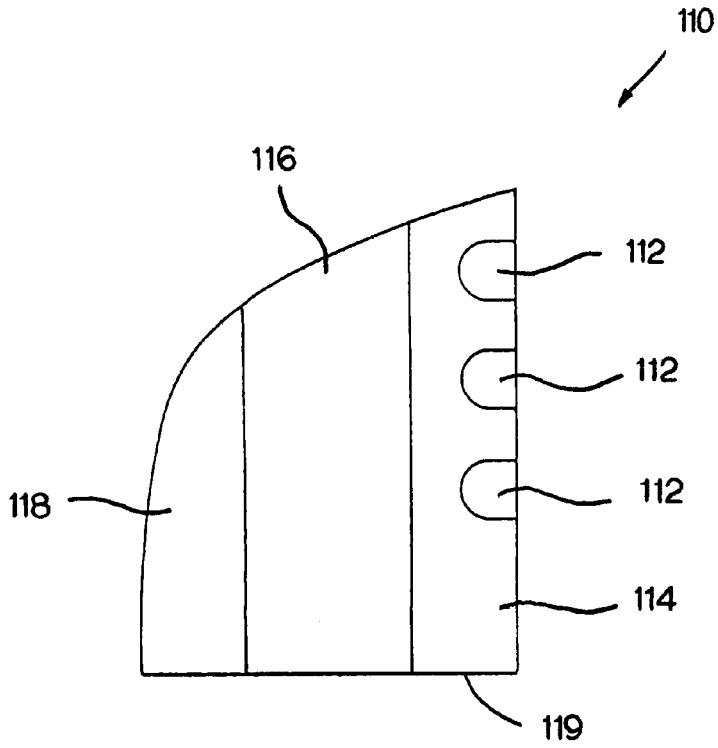
FIG. 5D is a side view of a sixth embodiment of a single blade from the fixed cutter bit of FIG. 2 with the PDC cutter elements removed from the blade so as to expose the grooves in the blade, and wherein the leading portion of the blade comprises a hard component-matrix composite material, the mediate portion of the blade comprises steel, and the trailing portion of the blade comprises cemented carbide.

FIG. 5D is a side view of a sixth embodiment of a single blade 110 from a fixed cutter bit along the lines of FIG. 2 with the PDC cutter elements removed from the blade 110 so as to expose the grooves 112 in the blade 110. The blade 110 has a leading portion 114, a mediate portion 116 and a trailing portion 118. The leading portion 114 of the blade 110 comprises a hard component-matrix composite material. The mediate portion 116 of the blade 110 comprises steel. The trailing portion 118 of the blade 110 comprises cemented carbide. For this embodiment, the leading portion; the mediate portion and the trailing portion can be joined together by any one of a number of techniques including without limitation brazing techniques and infiltration techniques. Although it will be discussed in more detail hereinafter, the blade 110 is joined at the radial inward edge 119 thereto the cutter bit body by any one of a number of techniques including without limitation brazing techniques, infiltration techniques, press fitting techniques, shrink fitting techniques, welding techniques, and mechanical technical techniques (e.g. mechanical fastening). The end result is that the blade is securely affixed to the cutter bit body.

Figure 5E:
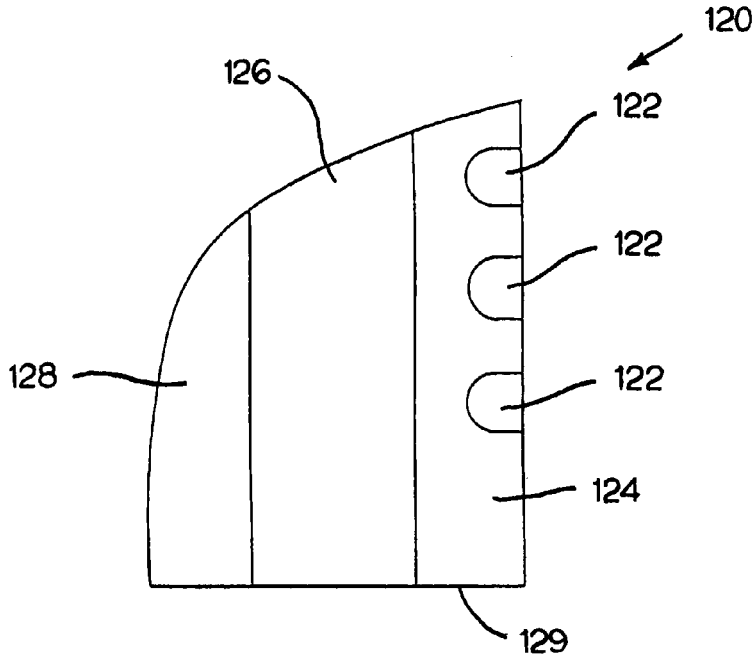
FIG. 5E is a side view of a sixth embodiment of a single blade from the fixed cutter bit of FIG. 2 with the PDC cutter elements removed from the blade so as to expose the grooves in the blade, and wherein the leading portion of the blade comprises steel, the mediate portion of the blade comprises a hard component-matrix composite material, and the trailing portion of the blade comprises cemented carbide.

FIG. 5E is a side view of a sixth embodiment of a single blade 120 from a fixed cutter bit along the lines of FIG. 2 with the PDC cutter elements removed from the blade 120 so as to expose the grooves 122 in the blade 120. The blade 120 comprises a leading portion 124, a mediate portion 126 and a trailing portion 128. The leading portion 124 of the blade 120 comprises steel, the mediate portion 126 of the blade 120 comprises a hard component-matrix composite material, and the trailing portion 128 of the blade 120 comprises cemented carbide. For this embodiment, the leading portion, the mediate portion and the trailing portion can be joined together by any one of a number of techniques including without limitation brazing techniques and infiltration techniques. Although it will be discussed in more detail hereinafter, the blade 120 is joined at the radial inward edge 129 thereto the cutter bit body by any one of a number of techniques including without limitation brazing techniques, infiltration techniques, press fitting techniques, shrink fitting techniques, welding techniques and mechanical technical techniques (e.g. mechanical fastening). The end result is that the blade is securely affixed to the cutter bit body.

Figure 5F:
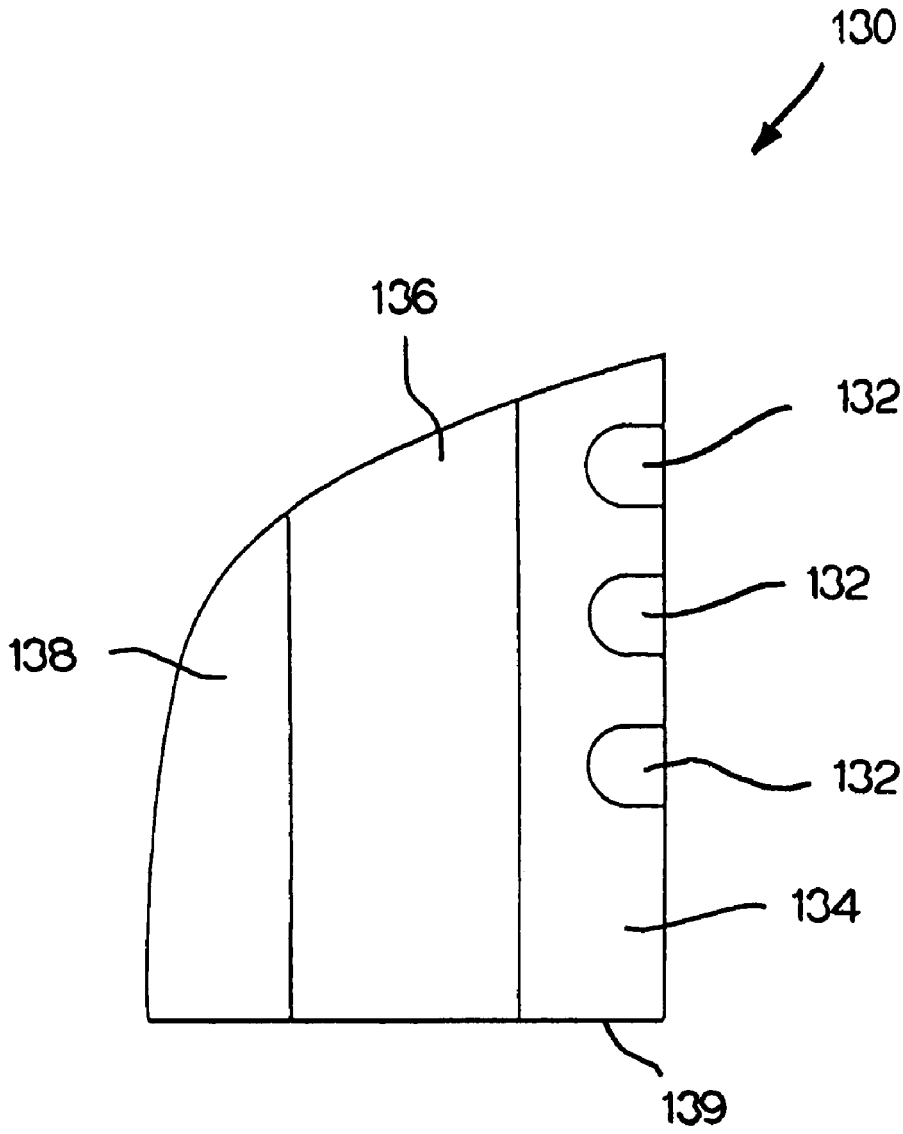
FIG. 5F is a side view of a sixth embodiment of a single blade from the fixed cutter bit of FIG. 2 with the PDC cutter elements removed from the blade so as to expose the grooves in the blade, and wherein the leading portion of the blade comprises steel, the mediate portion of the blade comprises cemented carbide, and the trailing portion of the blade comprises a hard component-matrix composite material.

FIG. 5F is a side view of a sixth embodiment of a single blade 130 from a fixed cutter bit along the lines of FIG. 2 with the PDC cutter elements removed from the blade 130 so as to expose the grooves 132 in the blade 130. The blade 130 comprises a leading portion 134, a mediate portion 136 and a trailing potion 138 that are joined together. The leading portion 134 of the blade 130 comprises steel, the mediate portion 136 of the blade 130 comprises cemented carbide, and the trailing portion 138 of the blade 130 comprises a hard component-matrix composite material. For this embodiment, the leading portion, the mediate portion and the trailing portion can be joined together by any one of a number of techniques including without limitation brazing techniques and infiltration techniques. Although it will be discussed in more detail hereinafter, the blade 130 is joined at the radial inward edge 139 thereto the cutter bit body by any one of a number of techniques including without limitation brazing techniques, infiltration techniques, press fitting techniques, shrink fitting techniques, welding techniques and mechanical technical techniques (e.g. mechanical fastening). The end result is that the blade is securely affixed to the cutter bit body.

Figure 6:
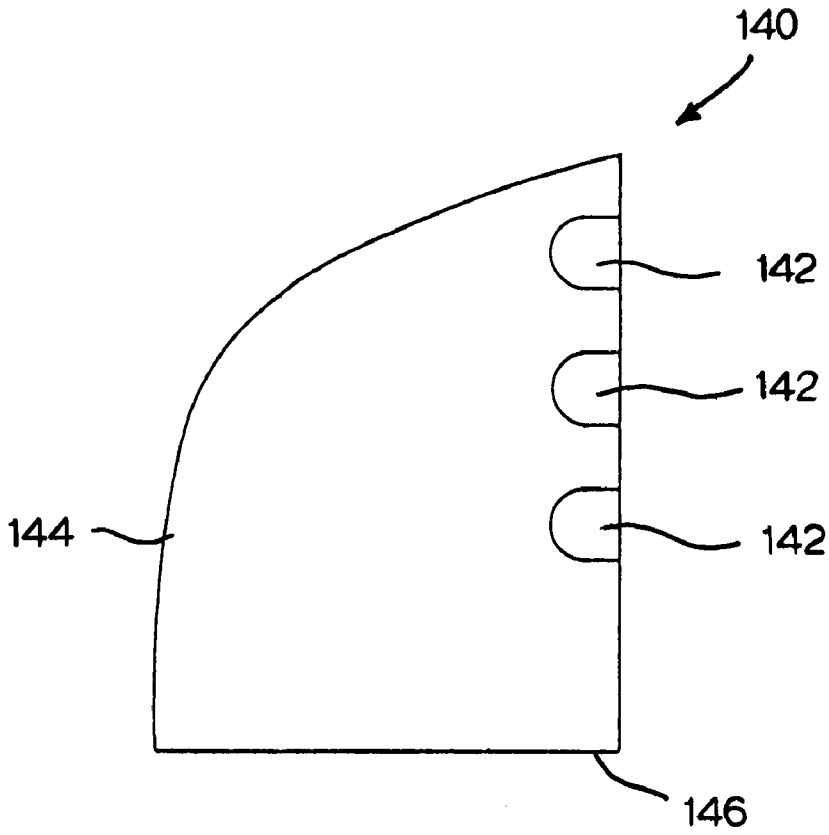
FIG. 6 is a side view of one embodiment of a single blade from the fixed cutter bit of FIG. 2 with the PDC cutter elements removed from the blade so as to expose the grooves in the blade, and wherein the blade comprises cemented tungsten carbide.

FIG. 6 is a side view of one embodiment of a single blade 140 from a fixed cutter bit along the lines of FIG. 2 with the PDC cutter elements removed from the blade 140 so as to expose the grooves 142 in the blade 140. The blade 140 is a single piece body 144 and it comprises cemented tungsten carbide. For this embodiment, although it will be discussed in more detail hereinafter, the blade 140 is joined at the radial inward edge 146 thereto the cutter bit body by any one of a number of techniques including without limitation brazing techniques, infiltration techniques, press fitting techniques, shrink fitting techniques, welding techniques and mechanical technical techniques (e.g. mechanical fastening). The end result is that the blade is securely affixed to the cutter bit body.

Figure 7:
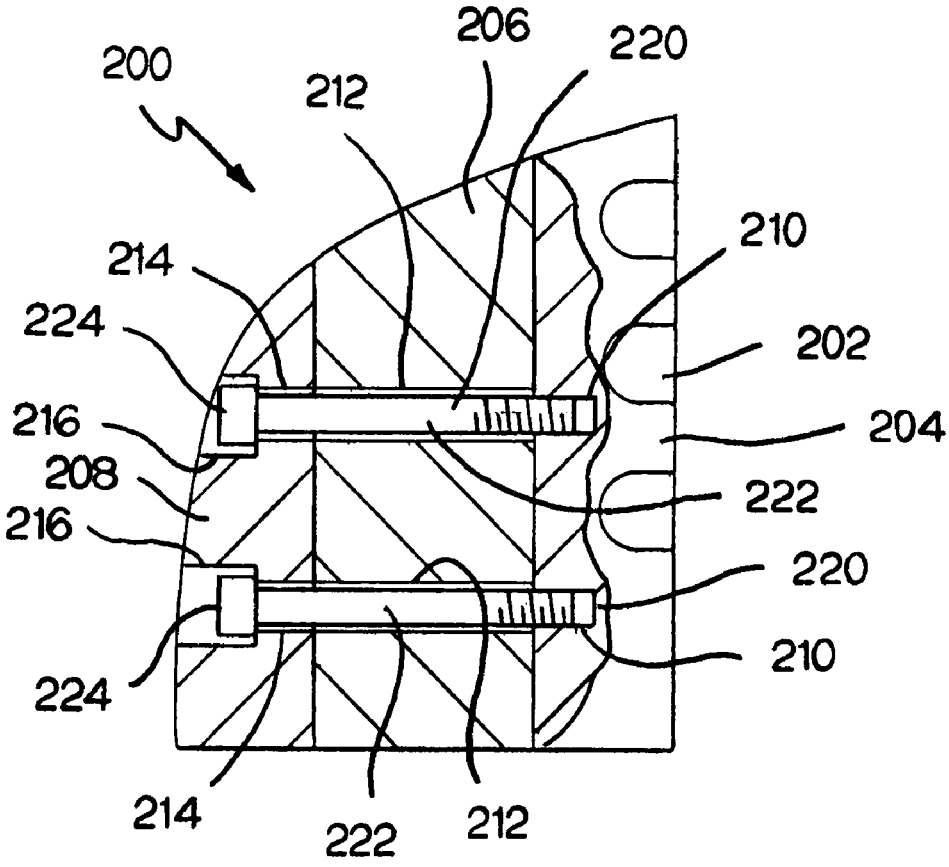
FIG. 7 is a side cross-sectional view of a seventh embodiment of a single blade suitable for use with the fixed cutter bit of FIG. 2 with the PDC cutter elements removed from the blade so as to expose the grooves in the blade and presenting three distinct portions held together with a pair of bolts passing therethrough, and wherein the leading portion of the blade comprises steel, the mediate portion of the blade comprises cemented carbide, and the trailing portion of the blade comprises a hard component-matrix composite material.

FIG. 7 illustrates a seventh specific embodiment of the blade of the invention generally designated as 200. Blade 200 comprises a single blade with the PDC cutter elements removed from the blade 200 so as to expose the grooves 202 in the blade 200. The blade 200 comprises three separate portions; namely, a leading portion 204, a mediate portion 206 and a trailing portion 208. The leading portion 200 of the blade 200 comprises steel and has a pair of threaded bores 210, the mediate portion 206 of the blade 200 comprises cemented carbide and has a pair of threaded bores 212, and the trailing portion 208 of the blade 200 comprises a hard component-matrix composite material and has a pair of threaded bores 214 wherein each one of the bores 214 has a recess 216 at the axial rearward end thereof.

As shown in FIG. 7, the leading portion 204, the mediate portion 206 and the trailing potion 208 are mechanically joined together via a pair of bolts 220. Bolt 220 has a bolt head 222 and an integral threaded shank 224. In order to assembly the portions together, the portions (204, 206, 208) are positioned next to one another so that the respective threaded bores (210, 212, 214) are in alignment. The bolts 220 are moved to engage the threads in the threaded bores and are tightened down so that the leading, mediate and trailing portions press very tightly against each other.

The seventh specific embodiment of the blade 200 provides a replacability (or repairability) feature for the blade 200. During a cutting or drilling operation, one or more (but not all of the separate portions (204, 206 208) of the blade 200 may become damaged to such an extent that replacement of the damaged portions is necessary. This embodiment permits replacement of only the damaged portion(s).

Replacement of only the damaged portion(s) can be accomplished by first detaching the blade 200 from the bit body. The complexity of detaching the blade 200 from the bit body can vary depending upon the manner of attachment between the blade and the bit body. Once the blade 200 is detached from the bit body, the bolts 220 are loosened so that the separate leading, mediate and trailing portions are detached from each other. The damaged portion(s) is replaced with an undamaged portion. The separate portions are the aligned and the bolts engaged the threaded bore and are tightened so as to cause the portions to press very tightly against each other.

The ability to replace a portion of the blade also exists for those blades in which the portions are joined together in such a fashion (e.g., brazing) so as to permit the disassembly of the portions. When a portion of a blade like the blade 60 in FIG. 4A suffers damage (or otherwise needs replacement), one can disassemble the leading portion from the trailing portion. The damaged portion or portion that needs replacement) is then replaced with a undamaged portion (or suitable portion) and the portions joined together.

The ability or capability to replace only a portion (e.g., the damaged portion(s)) of the blade body should reduce the overall operating costs because only a portion of the, and not the entire, blade is replaced. The ability to replace only a selected portion of the blade allows for the customization of the blade (even during the course of the drilling operation) to optimize performance. In this regard, of during the drilling (or cutting) operation one portion of the blade experiences undue or excessive wear or failure because of material selection, the damaged portion can be replaced by a corresponding portion made of a material more suitable to the specific drilling/cutting application or working environment. The replaceability or repairability feature thus serves to decrease the overall operating costs via a decrease in the cost of repair and the increase in operational performance.

Figure 9:
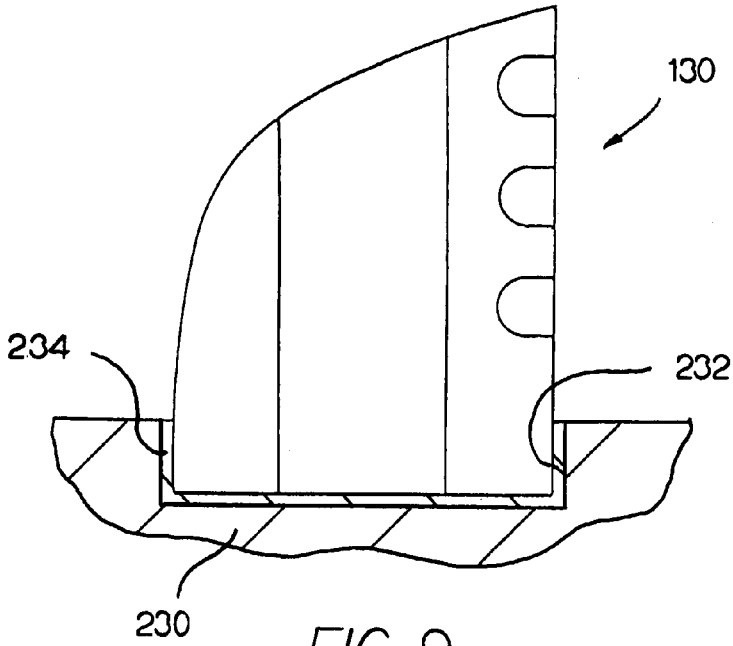
FIG. 9 is a side view of the sixth embodiment of a single blade of FIG. 5F wherein the blade is affixed by brazing in a slot or groove in the cutter bit body.
Figure 10:
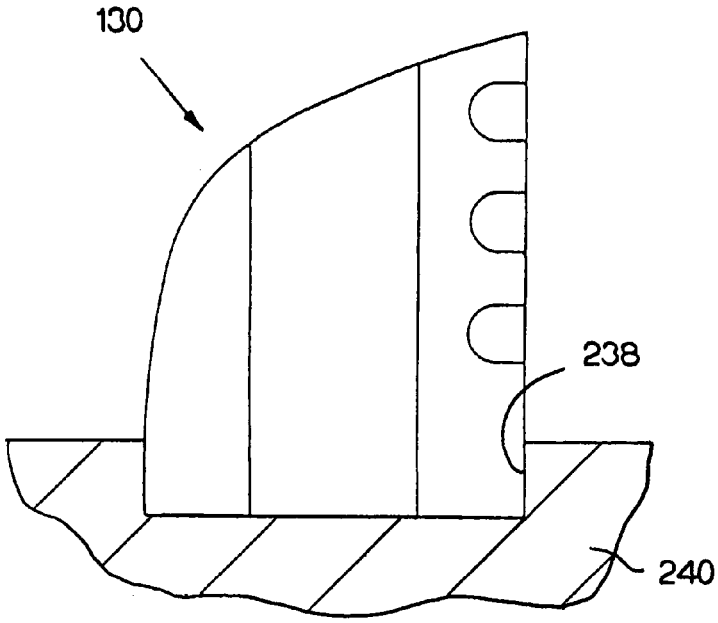
FIG. 10 is a side view of the sixth embodiment of a single blade of FIG. 5F wherein the blade is affixed by shrink fitting the blade into a slot.
Figure 11:
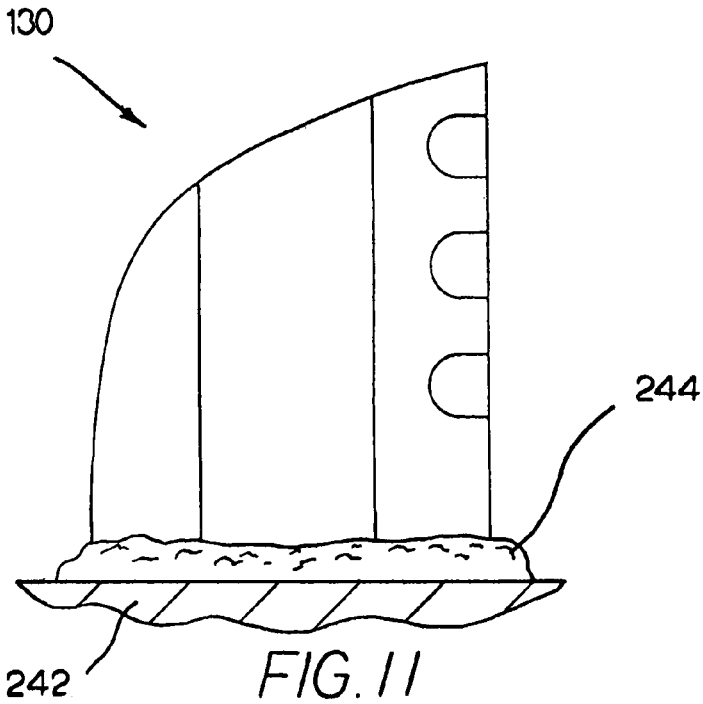
FIG. 11 is a side view of the sixth embodiment of a single blade of FIG. 5F wherein the blade is affixed by welding to the cutter bit body.

As mentioned above, there are a number of ways to attach or affix the blade to the cutter bit body. These methods include without limitation brazing techniques, infiltration techniques, press fitting techniques, shrink fitting techniques and welding techniques. FIGS. 9 through 11 illustrate the blade affixed to the cutter bit body by selected techniques.

More specifically, FIG. 9 illustrates the blade of FIG. 5F affixed to the cutter bit body 230 by brazing in a slot or groove 232 in the cutter bit body 230. There is a braze joint 234 shown between the blade 130 and the surface defining the slot 232. FIG. 10 shows the blade 130 of FIG. 5F wherein the blade 130 is affixed by shrink fitting the blade 130 into a slot 238 in the cutter bit body 240. FIG. 11 is a side view of the blade 130 of FIG. 5F wherein the blade 130 is affixed by welding to the cutter bit body 242 wherein the weld bead 244 is shown in this drawing.

Figure 12:
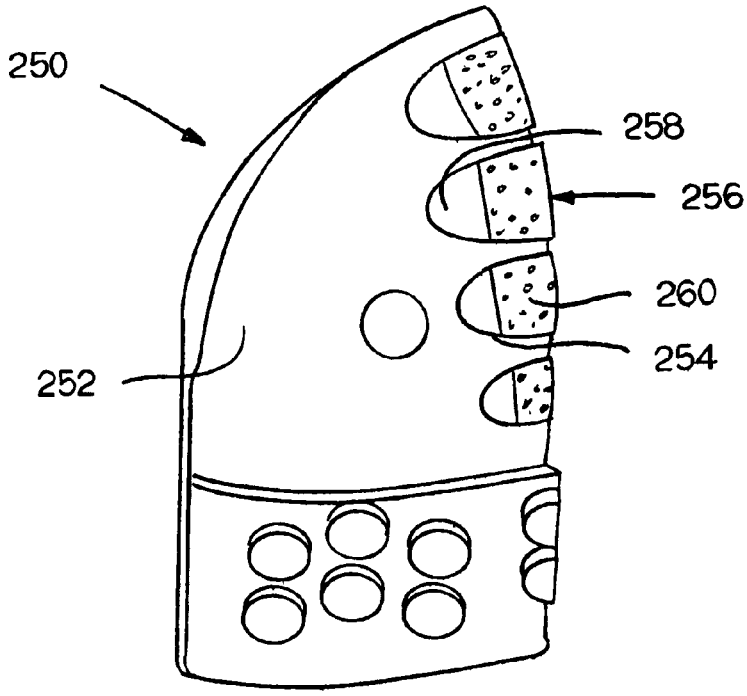
FIG. 12 is an isometric view of a single blade suitable for use with the fixed cutter bit of FIG. 2 wherein the cutter elements comprise polycrystalline diamond elements made according to U.S. Pat. No. 6,344,149 to Oles.

FIG. 12 is an isometric view of a single blade generally designated as 250 suitable for use with a fixed cutter bit along the lines of the cutter bit of FIG. 2. The blade 250 has a blade body 252 that contains a plurality of grooves 254. Each groove 254 receives a cutter element 256 that comprises polycrystalline diamond elements made according to U.S. Pat. No. 6,344,149 to Oles for POLYCRYSTALLINE DIAMOND MEMBER AND METHOD OF MAKING THE SAME, which is hereby incorporated by reference herein. The cutter element 256 that employs U.S. Pat. No. 6,344,149 to Oles et al. is a polycrystalline diamond member that includes a backing and a layer of polycrystalline diamond on the backing. The layer of polycrystalline diamond has an interior region adjacent to the backing and an exterior region adjacent to the interior region wherein the exterior region terminates at the rake surface. The interior region includes interior diamond particles and a catalyst with the interior diamond particles being bridged together so as to form interstices therebetween. The catalyst is at the interstices of the interior diamond particles. The exterior region includes exterior diamond particles bridged together so as to form interstices therebetween with the exterior region being essentially free of the catalyst. As an option, a chemical vapor deposition-applied hard material may be applied so as to essentially surround the exterior diamond particles. It should be appreciated that the cutter element can be used either with or without the CVD-applied hard material layer.

Figure 13:
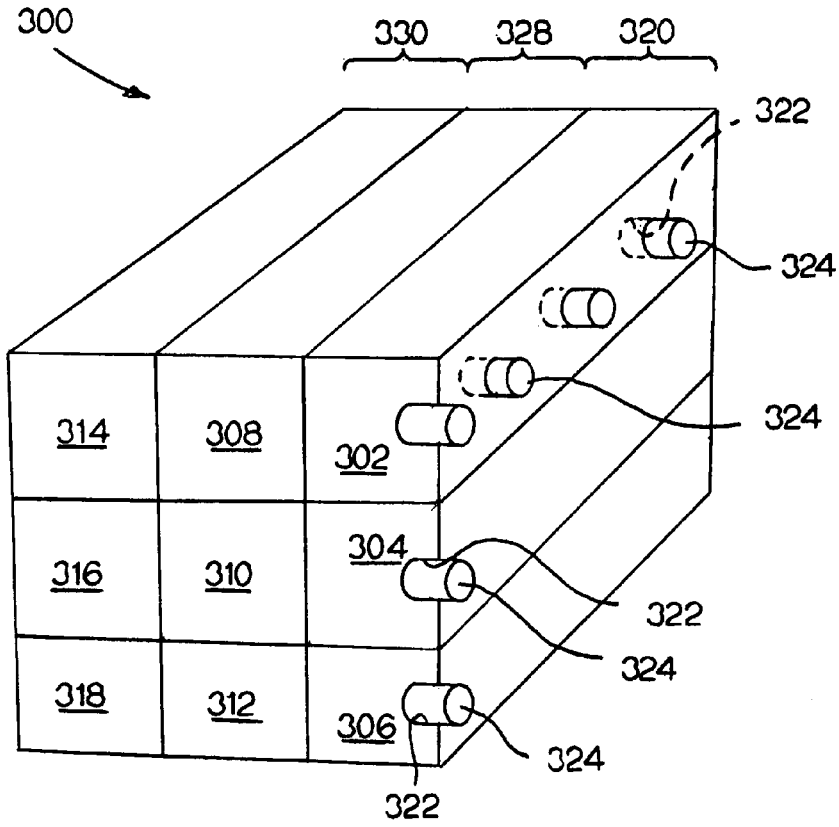
FIG. 13 is an isometric view of a single blade suitable for use with a fixed cutter bit along the lines of FIG. 2 wherein the single blade comprise nine pieces joined together.

FIG. 13 is an isometric view of a single blade 300 suitable for use with a fixed cutter bit along the lines of FIG. 2 wherein the single blade 300 comprise nine separate pieces (302, 304, 306, 308, 310, 312, 314, 316, 318) joined together. Typically, these nine pieces (302-318) are joined together by brazing or infiltration techniques. Further, it is noted that the blade 300 has a generally rectangular shape. While a blade of a rectangular shape is useful, it should be appreciated that the blade can take on other geometries and still comprise a plurality of separate pieces joined together to form the blade body. As will be discussed below, blade 300 presents a leading portion (see bracket 320), a mediate portion (see bracket 322) and a trailing portion (see bracket 324). To correlate the structure of the blade 300 to another earlier blade (e.g., blade 80 of FIG. 5A), the leading portion 320 corresponds to the leading portion 84 of blade 80, the mediate portion 328 corresponds to the mediate portion 86 of blade 80 and the trailing portion 330 corresponds to trailing portion 88 of blade 80.

Blade 300 can be considered to present a leading region (see bracket 320) that comprises pieces 302, 304 and 306. The leading region 320 carries the cutter elements. More particularly, piece 302 contains grooves 322 that receive the polycrystalline diamond cutter elements 324. The leading portion 320 typically experiences the greatest degree of abrasive wear because it carries the cutter elements that first impinge the earth strata.

The pieces (302-306) that comprise the leading region 320 typically are made from a material that exhibits a higher hardness than the other pieces that comprise the blade 300 because it experiences more abrasive wear. However, there may be specific applications that cause the wear to be uneven or unequal between the pieces (302-306) that comprise the leading region 320. In such a situation, it may prove to be beneficial to make the different pieces (302-306) from different kinds of materials or different compositions of the same basic material. By doing so, the wear of the pieces (302-306) may be more even, and thus, extend or optimize the overall life of the tool or bit.

Blade 300 also presents a mediate region (see bracket 328) that comprises pieces 308, 310 and 312. The mediate region 328 typically does not experience as much wear as does the leading region 320 or even the trailing region 330 (as described hereinafter). As a result, the mediate region 328 is best suited to comprise pieces that are made from material that absorbs impact forces during the drilling or cutting operation. In other words, the pieces 308-312 are made from impact-resistant materials. As mentioned in connection with the description of the leading region 320, there may be instances where the wear of the pieces (308-312) is unequal. In such a circumstance, the material from which each piece (308-312) is made can be selected so that the wear or performance is more equal.

Blade 300 also presents a trailing region (see brackets 330). Trailing region 330 comprises pieces 314, 316 and 318. The pieces (314-318) that comprise the trailing region 330 typically are made from a material that exhibits a higher hardness than the pieces in the mediate region 328, but equal to or even lower than the pieces that comprise the leading region 300. While the trailing region experiences more wear than does the mediate region, it typically experiences less wear than the leading region. There may be specific applications that cause the wear to be uneven or unequal between the pieces (314-318) that comprise the trailing region 330. In such a situation, it may prove to be beneficial to make the different pieces (314-318) from different kinds of materials or different compositions of the same basic material. By doing so, the wear of the pieces (314-318) may be more even, and thus, extend or optimize the overall life of the tool or bit.

It should be appreciated that the material selection parameters for the blade 300 may be such that the material differs in a radial direction. More specifically, the pieces 302, 308 and 314 may comprise one kind of material (e.g., cemented carbide). The middle row of pieces 304, 310 and 316 may comprise another kind of material such as, for example, the hard composite material or steel. The bottom row of pieces 306, 312 and 318 may comprise still another kind of material or a material (e.g., the hard composite material) like the material of the above rows. Again it is emphasized that there is a wide range of possibilities when it comes to material selection and material positioning of the pieces. Such a wide range of possibilities for the material selection ad positioning provides the ability to customize the blade to a particular drilling or cutting application.

Figure 16:
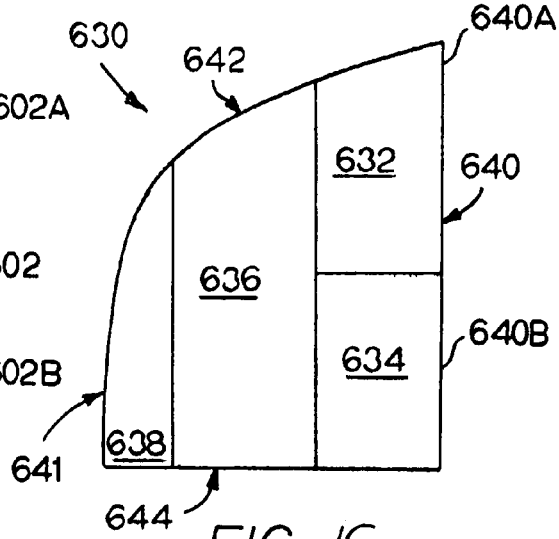
FIG. 16 is a side view of a blade that comprises four portions joined together.
Figure 17:
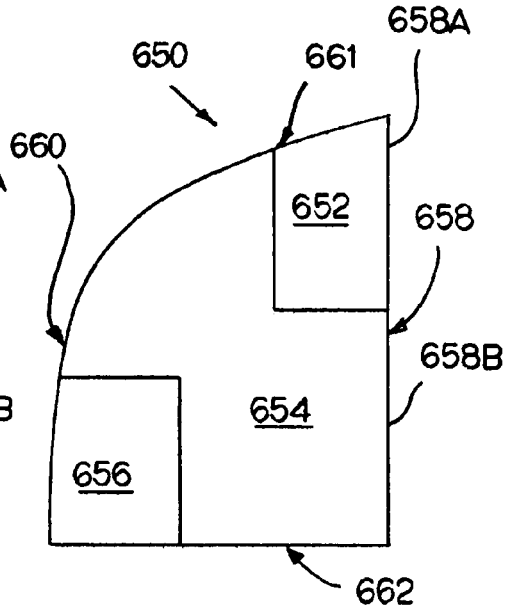
FIG. 17 is a side view of a blade that comprises three portions joined together.
Figure 18:
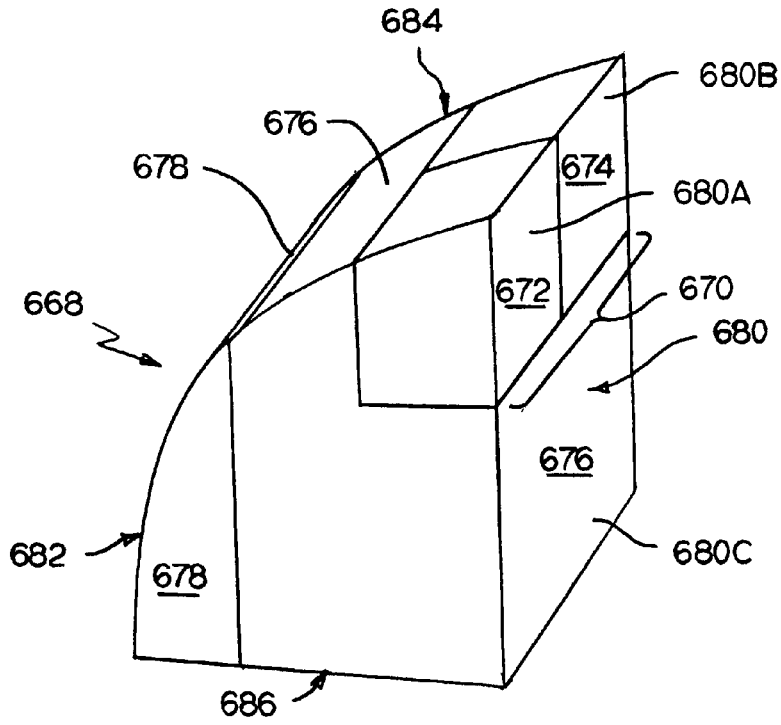
FIG. 18 is an isometric view of a blade that comprises three basic portions joined together.

Referring to FIGS. 14 through 19, these drawings illustrate a number of different arrangements of portions of blades useful for attachment to a cutter bit body or useful for other cutting applications such as listed hereinabove. As is apparent from the variety of arrangements of the various portions in the blades, the present invention allows for a wide variety of arrangements and orientations of blade portions that have different properties (e.g., hardness, abrasion resistance, erosion resistance and toughness) to accommodate many different drilling and cutting conditions and environments to achieve the optimum performance for a specific drilling or cutting application. For each one of the blades it should be appreciated that each portion thereof could be made of one or more segments that extend in a generally transverse direction across the face of the blade such as, for example as is shown in FIG. 18. For each one of the blades, even though grooves are absent from these drawings, it should be appreciated that grooves, which are useful to carry cutter elements, may exist in a selected surface at selected location(s).

Figure 14:
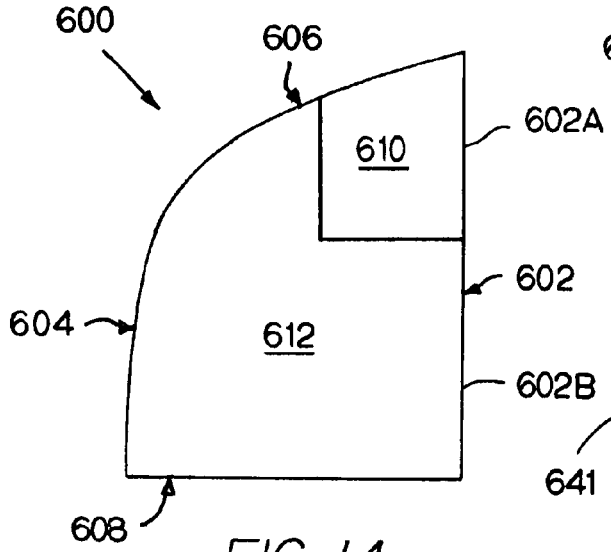
FIG. 14 is a side view of a blade that comprises two portions joined together.

FIG. 14 is a side view that shows a blade generally designated as 600 that comprises two portions (610, 612) joined together. Portion 610 is made from either a cemented carbide or the hard composite material and portion 612 is made from steel. Blade 600 has a leading surface 602, a trailing surface 604, a top (or radial outward) surface 606 and a bottom (or radial inward) surface 608. In this embodiment, the leading surface 602 comprises two different surfaces 602A and 602B of different materials (i.e., cemented carbide or hard composite and steel, respectively). By providing a leading surface that exhibits surface portions of different materials, the blade can be customized to exhibit a wide variety of properties.

Figure 15:
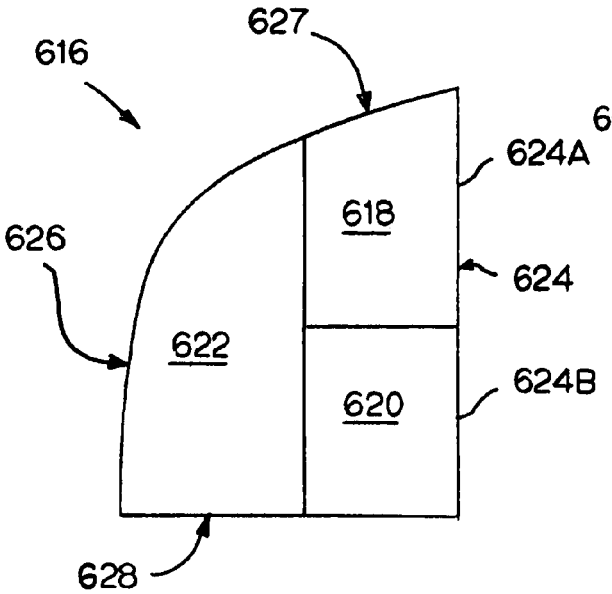
FIG. 15 is a side view of a blade that comprises three portions joined together.

FIG. 15 is a side view that shows a blade generally designated as 616 that comprises three portions (618, 620, 622) joined together. Portion 618 is made of cemented carbide, portion 620 is made of either cemented carbide or the hard composite material, and portion 622 is made of steel. Blade 616 has a leading surface 624, a trailing surface 626, a top (or radial outward) surface 627 and a bottom (or radial inward) surface 628. In this embodiment, the leading surface 624 comprises two different surfaces 624A and 624B of different materials (i.e., cemented carbide and hard composite or cemented carbide, respectively). By providing a leading surface that exhibits surface portions of different materials, the blade can be customized to exhibit a wide variety of properties.

FIG. 16 is a side view that shows a blade generally designated as 630 that comprises four portions (632, 634, 636, 638) joined together. Portion 632 is made from cemented carbide, portion 634 is made from cemented carbide, portion 636 is made from the hard composite material, and portion 638 is made from steel. Blade 630 has a leading surface 640, a trailing surface 641, a top (or radial outward) surface 642 and a bottom (or radial inward) surface 644. In this embodiment, the leading surface 640 comprises two different surfaces 640A and 640B of cemented carbide wherein the cemented carbides could be the same grade or different grades. By providing a leading surface that exhibits surface portions of different materials, the blade can be customized to exhibit a wide variety of properties.

FIG. 17 is a side view that shows a blade generally designated as 650 that comprises three portions (652, 654, 656) joined together. Portion 652 is made from cemented carbide, portion 654 is made from a hard composite material, and portion 656 is made from steel. Blade 650 has a leading surface 658, a trailing surface 660, a top (or radial outward) surface 661 and a bottom (or radial inward) surface 662. In this embodiment, the leading surface 658 comprises two different surfaces 658A and 658B of different materials (i.e., cemented carbide and hard composite, respectively). By providing a leading surface that exhibits surface portions of different materials, the blade can be customized to exhibit a wide variety of properties.

FIG. 18 is an isometric view that shows a blade generally designated as 668 that comprises three portions (see bracket 670, 676, 678) joined together. Portion 670 comprises two separate, but joined, pieces or segments 672 and 674. These segments 672 and 674 are made of cemented carbide wherein these segments may be of the same grade or different grades of cemented carbide. Further, it is contemplated that both of the segments (672, 674) could be made of a different kind of material (e.g., the hard composite material). It is also contemplated that one segment (e.g., segment 672) could be made from one kind of material (e.g., cemented carbide) and the other segment (e.g., segment 674) be made from another kind of material (e.g., the hard composite material).

Portion 676 is made from a hard composite material. While portion 676 is shown as comprising a single piece, it should be appreciated that portion 676 may comprise a plurality of pieces or segments that are joined together. Portion 678 is made from steel. Again, like for portion 676, while portion 678 is shown as comprising a single piece, it should be appreciated that portion 678 may comprise a plurality of pieces or segments that are joined together. Blade 668 has a leading surface 680, a trailing surface 682, a top (or radial outward) surface 684 and a bottom (or radial inward) surface 686.

In the embodiments such as illustrated in FIGS. 14-18, it should be appreciated that the different portions, if damaged or otherwise determined to require replacement, can be replaced with undamaged or suitable portions. When a portion of a blade suffers damage (or otherwise needs replacement), one can disassemble the necessary portions from one another, and the damaged portion (or portion that needs replacement) is then replaced with a undamaged portion (or suitable portion) and the portions joined together.

Figure 19:
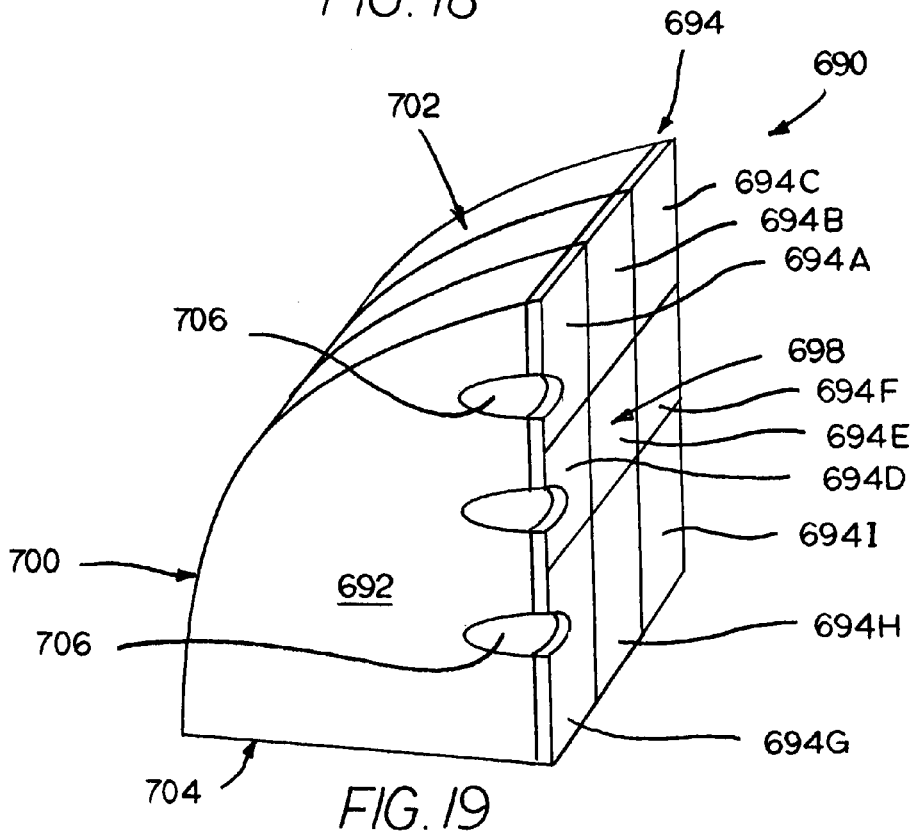
FIG. 19 is an isometric view of a blade that presents a plurality of tiles that define the leading surface of the blade.

FIG. 19 is an isometric view of a blade generally designated as 690. Blade 690 comprises two basic portions (692, 694) joined together. Portion 692 can be made of the hard composite material or steel. The other portion generally designated as 694 is comprised of nine separate so-called tiles or pieces of material (694A through 6941). In this specific embodiment, each one of the tiles is of a generally rectangular shape. However, it is contemplated that the tiles may be of a different shape such as, for example, triangular. It is also contemplated that tiles of different shapes (e.g., rectangular tiles in combination with triangular tiles) may comprise portion 694. Each of these tiles (694A-694I) can be made of cemented carbide wherein the cemented carbide is of the same grade or of different grades or of the hard composite material or of steel. It should be appreciated that the material selection for the cemented carbide can vary depending upon the specific drilling or cutting application. Portion 692 may be made of any one of cemented carbide, steel or the hard composite material depending upon the specific application. Blade 690 has a leading surface 698, a trailing surface 700, a top (or radial outward) surface 702 and a bottom (or radial inward) surface 704. Blade 690 also contains a plurality of grooves 706 that carry cutter elements.

A part of the groove 706 is in portion 692 and the other part of the groove is in the selected tiles. In the case of the specific embodiment of FIG. 19, these tiles comprise tiles 694A, 694D and 694G. If one of the tiles that contains a portion of the groove or a groove become damaged, the damaged tile can be detached and replaced with a similar undamaged tile.

The compositional aspects of the various portions of the blades may vary depending upon the specific drilling application. In this respect, it should be appreciated that changes in the composition or microstructure of the material results in changes in the properties of the material. For example, while there can be exceptions based upon other compositional factors, generally speaking, a decrease in the cobalt content of a cemented (cobalt) tungsten carbide material typically results in a higher hardness (as well as higher abrasion resistance and erosion resistance) and a lower toughness. An increase in the cobalt content of a cemented (cobalt) tungsten carbide material typically results in a lower hardness (as well as lower abrasion resistance and erosion resistance) and a higher toughness. The grain size of the tungsten carbide also impacts the hardness in that a smaller or finer grain size typically results in a harder material with all other parameters remaining the same. Further, it should be appreciated that different materials provide different properties (e.g., hardness, abrasion resistance, erosion resistance, and toughness). For example, generally speaking, steels typically exhibit a lower hardness, but higher toughness than do cemented carbides. The ability to vary the compositional aspects of the portions of the blades allows for the customization of the blades to suit specific drilling conditions including specific earth formations. As will become apparent, the material from which the blades are made is selected from the group consisting of (a) cemented carbide, and (b) steel, and (c) a hard composite comprising a plurality of hard constituents and matrix powder of hard particles and an infiltrant alloy bonded together to form the hard composite.

In reference to the composition of the cemented tungsten carbide, the cemented tungsten carbides may be any one of a number grades of cemented tungsten carbide that are suitable for borehole drilling operations. These cemented tungsten carbide grades may include grades that comprise between about 0.01 weight percent and about 35 weight percent cobalt with the balance tungsten carbide (the average grain size varies between about 0.01 microns and about 25 microns) and recognized impurities. These cemented tungsten carbide grades may also include grades that comprise between about 0.01 weight percent and about 35 weight percent cobalt, various additives (e.g., the carbides, nitrides and/or carbonitrides of the elements (except for tungsten) of Group IVa, Va, and VIa of the Periodic Table) with the balance tungsten carbide (the average grain size varies between about 0.01 microns and about 25 microns), and recognized impurities. Another compositional range of the cemented (cobalt) tungsten carbide is a cobalt content between about 6 weight percent and about 25 weight percent with the balance tungsten carbide (average grain size between about 2 microns to about 12 microns) and recognized impurities.

Preferred grades of cemented tungsten carbide comprise the following exemplary compositions of cemented (cobalt) tungsten carbide (without limitation): (A) about 6 weight percent cobalt with the balance tungsten carbide (average grain size ranging between about 2 microns to 6 microns) and recognized impurities, and having a hardness equal to 90.0-91.5 Rockwell A and a fracture toughness equal to between about 8 and about 14 $MPa \cdot m^{1/2}$; (B) about 10 weight percent cobalt with the balance tungsten carbide (average grain size ranging between about 2 microns to 8 microns) and recognized impurities, and having a hardness equal to 87.0-89.0 Rockwell A and a fracture toughness equal to between about 10 and about 17 $MPa \cdot m^{1/2}$; (C) about 12 weight percent cobalt with the balance tungsten carbide (average grain size ranging between about 4 microns to 12 microns) and recognized impurities; about 13-14 weight percent cobalt with the balance tungsten carbide (average grain size ranging between about 2 microns to 6 microns) and recognized impurities, and having a hardness equal to 87.5-89.5 Rockwell A and a fracture toughness equal to between about 10 and about 17 $MPa \cdot m^{1/2}$; about 16 weight percent cobalt with the balance tungsten carbide (average grain size ranging between about 4 microns to 10 microns) and recognized impurities, and having a hardness equal to 85.0-87.0 Rockwell A and a fracture toughness equal to between about 12 and about 20 $MPa \cdot m^{1/2}$; and about 20 weight percent cobalt with the balance tungsten carbide (average grain size ranging between about 2 microns to 4 microns) and recognized impurities, and having a hardness equal to 84.5-86.5 Rockwell A and a fracture toughness equal to between about 14 and about 24 $MPa \cdot m^{1/2}$. The fracture toughness is measured according to the ASTM Standard B771 B771-87(2001) Standard Test Method for Short Rod Fracture Toughness of Cemented Carbides.

Another suitable grade of cemented (cobalt) carbide has a composition of up to 0.25 weight percent cobalt with the balance tungsten carbide that has an average grain size less than or equal to about 1 micron and recognized impurities. Other grades of cobalt-bonded cemented carbides (and their properties) are disclosed in the article by Santhanam et al., entitled "Cemented Carbides" Metals Handbook Volume 2, $10^{th}$ Edition Properties and Selection, wherein this article is hereby incorporated in its entirety by reference herein. The ability to vary the compositional aspects of the cemented carbide portions of the blades allows for the customization of the blades to suit specific drilling conditions including specific earth formations.

In reference to the composition of the steel used as a portion of the blades, it is contemplated that many different steel compositions are suitable. Broadly speaking, these steel compositions may include low alloy steels, alloy steels boron alloy steels, and air hardened steels.

Particularly suitable steel compositions include the following: AISI 4140 steel and AISI 316 stainless steel. The nominal composition (in weight percent) for the AISI 4140 steel is: 0.38-0.43% carbon, 0.75-1.00% manganese, 0.035% phosphorous, 0.040% sulfur, 0.15-0.35% silicon, 0.80-1.10% chromium, 0.15-0.25% molybdenum and the balance iron. The nominal composition (in weight percent) for 316 stainless steel is: maximum carbon 0.08%, maximum manganese 2.00%, maximum phosphorous 0.030%, maximum silicon 0.030%, 10.00-16.00% nickel, 16.00-18.00% chromium, 2.00-3.00% molybdenum, and the balance iron. It is contemplates that other stainless steel compositions may also be suitable wherein these include austenitic stainless steels because of their high wear and impact resistance from room temperature down to cryogenic temperatures. Of the austenitic stainless steels, AISI types 301, 302, 304 and 304L grades appear to be suitable. In addition to the above steels, the following steels are also suitable: Grade 1020 steel with a composition (in weight percent) of 0.18%-0.23% carbon, 0.3%-0.6% manganese, 0.05 maximum sulfur, 0.05 maximum phosphorous, and the balance iron; Grade 8740 steel with a composition (in weight percent) of 0.38%-0.43% carbon, 0.75%-1.0% manganese, 0.4%-0.6% chromium, 0.4%-0.7% nickel, 0.2%-0.3% molybdenum, 0.15%-0.035% silicon, 0.05 maximum sulfur, 0.05 maximum phosphorous, and the balance iron; Grade 15B37 steel with a composition of 0.30%-0.39% carbon, 1.0%-1.5% manganese, 0.0005-0.003% boron, 0.037-0.05 titanium, 0.05 maximum sulfur, 0.05 maximum phosphorous, and the balance iron; Grade 4715 steel with a composition (in weight percent) of 0.13-0.18% carbon, 0.7-0.9% manganese, 0.45-0.65% chromium, 0.7-1.0% nickel, 0.45-0.65% molybdenum, 0.15%-0.035% silicon, 0.035% maximum sulfur, 0.035% maximum phosphorous, and the balance iron; and Grade A7 steel with a composition (in weight percent) of about 2.25% carbon, 0.8% maximum manganese, 5%-5.75% chromium, 0.7-1.0% nickel, 0.9-1.4% molybdenum, 0.15%-5% silicon, 0.035% maximum sulfur, 0.035% maximum phosphorous, 3.9-5.2% vanadium, 0.5-1.5% tungsten and the balance iron.

It should be appreciated that the composition and microstructure of the steel grades can impact the properties useful to the performance of the blade in a drilling or cutting application. Like for the cemented carbides, the hardness, toughness, erosion resistance and abrasion resistance are properties of the steel that impact upon the performance of the blade during use. As can also be appreciated, the composition and microstructure of steels can vary to a great extent so that the portions of the blades made from steel can exhibit a wide variety of properties to accommodate a wide variety of drilling or cutting applications. In this regard, the treatment of the steel can impact the properties even though the chemical composition remains essentially the same. Databases such as, for example, MatWeb.com on the internet, provide properties for a wide variety of steels.

Although not described as a specific embodiment, it should be appreciated that the portion(s) of the blades that are described as being made of steel could also be made from other ferrous and non-ferrous alloys. These portions could comprise a casting having hard particles therein or white cast iron. Whatever the material of these portions, it is beneficial if the material possesses properties so that it is bondable with an infiltrant alloy when bonded to a hard component-matrix composite material. It is also beneficial if the steel material is brazable with the cemented tungsten carbide portion. The ability to vary the compositional aspects of the steel portions (or the other ferrous and non-ferrous portions) of the blades allows for the customization of the blades to suit specific drilling conditions including specific earth formations.

In reference to the composition of the hard component-matrix composite material portion of the blades, the compositions set forth in U.S. Pat. No. 6,984,454 to Majagi entitled WEAR-RESISTANT MEMBER HAVING A HARD COMPOSITE COMPRISING HARD CONSTITUENTS HELD IN AN INFILTRANT MATRIX, that is assigned to Kennametal Inc., are especially suitable for use as the hard component-matrix composite material portion of the blades. U.S. Pat. No. 6,984,454 to Majagi is hereby incorporated by reference herein.

In reference to the hard component-matrix composite material, it comprises a plurality of discrete hard constituents (described hereinafter) wherein these hard constituents are held within a matrix. The matrix comprises a mass of matrix powder that comprises different kinds of hard particles and/or powders, and an infiltrant alloy that has been infiltrated into the mass of the matrix powder and the hard constituents under the influence of heat and sometimes under additional environmental influences such as, for example, in a pressure or in a vacuum. Furthermore, the infiltrant alloy may be infiltrated into the mass of hard constituents and matrix powder under various atmospheres (e.g., argon, helium, hydrogen, and nitrogen).

The hard constituents may comprise sintered cemented carbide members (which hereinafter may be called sintered cemented carbide members) that can be of various geometric shapes such as, for example, triangular. The hard constituent presents a specific pre-determined shape. This shape can vary depending upon the specific application for the tough wear-resistant hard member. Powder metallurgical techniques allow for the shape of the sintered cemented carbide member to take on any one of a number of shapes or geometries. In one alternative, it is contemplated that the hard constituents are of a size so as to have a surface area that ranges between about 0.001 square inches (0.006 square centimeters) and about 16 square inches (103 square centimeters) on each exposed surface (or facet) of the sintered cemented carbide member. In this regard, for example, the sintered cemented carbide member may have a plurality of exposed surfaces wherein one exposed surface has a hard constituent that occupies between about 0.006 square centimeters and about 103 square centimeters of surface area and another exposed surface that has a hard constituent that occupies between about 0.006 square centimeters and about 103 square centimeters of surface area. It is also contemplated that the sintered cemented carbide member may be of a size that ranges between about 0.005 square inches (0.03 square centimeters) and about 5 square inches (33 centimeters). It is further contemplated that the sintered cemented carbide member may be of a size that ranges between about 0.0005 square inches (0.003 square centimeters) and about 0.5 square inches (0.003 centimeters).

It is further contemplated that the sintered cemented carbide member may be of a size so as to present one or more exposed surfaces wherein each exposed surface has a hard constituent that occupies between about 5 square inches (32.35 square centimeters) and about 225 square inches (1451.59 square centimeters). Alternate ranges of the surface area of the hard constituent on each exposed surface can be in one instance between about 25 square inches (161.29 square centimeters) and about 200 square inches (1290.3 square centimeters), in another instance between about 50 square inches (322.58 square centimeters) and about 150 square inches (96.68 square centimeters), in another instance between about 75 square inches (483.87 square centimeters) and about 125 square inches (801.39 square centimeters) and in still another instance between about 50 square inches (322.58 square centimeters) and about 110 square inches (709.61 square centimeters).

As an alternative, a hard sintered cemented carbide member could be crushed to obtain hard constituents wherein the hard constituents are crushed particles of a larger size wherein the particle size is measured by mesh size (e.g., −80+120 mesh).

The hard constituents are selectively positioned within the matrix of the hard composite which typically occurs in the mold prior to infiltration. It is contemplated that the hard constituents may cover between about 0.5 percent to about 90 percent of the surface area of the wear-resistant hard member. Applicant does not intend to restrict the invention to the specific positioning of the hard constituents in the hard composite. For example, the hard constituents may be uniformly (or non-uniformly or randomly) distributed throughout the volume of the hard composite.

One composition of the sintered cemented carbide member 34 is cobalt cemented tungsten carbide wherein the cobalt ranges between about 0.2 weight percent and about 6 weight percent of the cobalt cemented tungsten carbide member and tungsten carbide is the balance of the composition. Another composition for the sintered cemented carbide member 34 is cobalt cemented tungsten carbide wherein the cobalt ranges between about 6 weight percent and about 30 weight percent of the cobalt cemented tungsten carbide member and tungsten carbide is the balance of the composition. In still another composition, the sintered cemented carbide member may comprise cobalt (10 weight percent cobalt) cemented tungsten carbide.

By mentioning the above specific hard constituent, applicant does not intend the limit the scope of the invention to this specific hard constituent. Applicant contemplates that other materials would be suitable for use as the hard constituents in the hard composite. In this regard, the following materials would appear to be suitable for use as hard constituents in the hard composite: sintered cemented tungsten carbide wherein a binder includes one or more of cobalt, nickel, iron and molybdenum; coated sintered cemented tungsten carbide wherein a binder includes one or more of cobalt, nickel, iron and molybdenum, and the coating comprises one or more of nickel, cobalt, iron and molybdenum; one or more of the carbides, nitrides, and borides of one or more of titanium, niobium, tantalum, hafnium, and zirconium; one or more of the coated carbides, coated nitrides, and coated borides of one or more of titanium, niobium, tantalum, hafnium, and zirconium wherein the coating comprises one or more of nickel, cobalt, iron and molybdenum; chromium carbides; coated chromium carbides; coated silicon carbide wherein the coating comprises one or more of nickel, cobalt, iron and molybdenum; and coated silicon nitride wherein the coating comprises one or more of nickel, cobalt, iron, copper, molybdenum or any other suitable metal; and coated boron carbide wherein the coating comprises one or more of nickel, cobalt, iron, copper, molybdenum, and any other suitable metal.

The matrix powder can comprise a crushed cemented carbide particle. The crushed cemented carbide particles may be present in a size range for these crushed cemented carbide particles equal to −325+200 mesh. Another size range for these crushed cemented carbide particles is −80+325 mesh. The standard to determine the particle size is by using sieve size analysis and the Fisher sub-sieve size analyzer for −325 mesh particles. One composition for the crushed cemented carbide particles is cobalt cemented tungsten carbide wherein the cobalt ranges between about 6 weight percent and about 30 weight percent of the cobalt cemented tungsten carbide material and tungsten carbide is the balance of the material. Another preferred composition for crushed cemented carbide particles is cobalt cemented tungsten carbide wherein the cobalt ranges between about 0.2 weight percent and about 6 weight percent of the cobalt cemented tungsten carbide material and tungsten carbide is the balance of the material.

By mentioning specific compositions, applicant does not intend the limit the scope of the invention to these specific cemented carbides. Applicant contemplates that other cemented carbides (e.g., chromium carbide) would be suitable for use as the crushed cemented tungsten carbide particles in the hard composite. In this regard, the carbides could be different from tungsten carbide (e.g., titanium carbide and chromium carbide) and the binder could be different from cobalt (e.g., nickel). Applicant further contemplates that the crushed cemented carbide particles may vary in composition throughout a particular hard composite depending upon the specific application. Applicant also contemplates that certain hard materials other than cemented carbides may be suitable to form these particles.

The matrix may also contain crushed cast carbide particles wherein one size range for these particles is −325 mesh. Another size range for these particles is −80 mesh. One composition for these particles is cast tungsten carbide. Applicant contemplates that the crushed cast carbide particles may vary in composition throughout a particular hard composite depending upon the specific application. Applicant further contemplates that other cast carbides or hard materials are suitable for use in place or along with the crushed cast carbide particles.

The matrix powder may further include in addition to crushed cemented carbide particles and/or crushed cast carbide particles, any one or more of the following: crushed carbide particles (e.g., crushed tungsten carbide particles that have a size of −80+325 mesh), steel particles that have an exemplary size of −325 mesh, carbonyl iron particles that have an exemplary size of −325 mesh, cemented carbide powder, and coated (e.g., nickel coating) cemented carbide particles, and nickel-coated tungsten carbide particles (−80+325 mesh).

As discussed above, it is desirable that the infiltrant alloy 31 has a melting point that is low enough so as to not degrade the hard constituents upon contact therewith during the infiltration process. Along this line, the infiltrant alloy has a melting point that ranges between about 500 degrees Centigrade and about 1400 degrees Centigrade. Applicant contemplates that the infiltrant alloys may have a melting point that ranges between about 600 degrees Centigrade and about 800 degrees Centigrade. Applicant further contemplates that the infiltrant alloys may have a melting point that ranges between about 690 degrees Centigrade and about 770 degrees Centigrade. Applicant still further contemplates that the infiltrant alloys may have a melting point below about 700 degrees Centigrade. Exemplary general types of infiltrant alloys include copper-based alloys such as, for example, copper-silver alloys, copper-zinc alloys, copper-nickel alloys, copper-tin alloys, and nickel-based alloys including nickel-copper-manganese alloys. Exemplary infiltrant alloys are set forth in Table 1 herein below.

TABLE 1

Compositions of Infiltrant Alloys in Weight Percent

| Alloy/ Composition | Cu | Ni | Zn | Mn | Ag | Sn | Nb | Solidus (Melting Point) (° C.) | Liquidus (Flow Point) ° C. |
|---|---|---|---|---|---|---|---|---|---|
| A-1 | 53 | 15 | 8 | 24 | — | — | — | 1150 | |
| 202 | 45 | — | 35 | — | 20 | — | — | 710 | 815 |

TABLE 1-continued

Compositions of Infiltrant Alloys in Weight Percent

| Alloy/ Composition | Cu | Ni | Zn | Mn | Ag | Sn | Nb | Solidus (Melting Point) (° C.) | Liquidus (Flow Point) ° C. |
|---|---|---|---|---|---|---|---|---|---|
| 255 | 40 | — | 33 | — | 25 | 2 | — | 690 | 780 |
| 559 | 42 | 2 | — | — | 56 | — | — | 770 | 895 |
| 700 | 20 | — | 10 | — | 70 | — | — | 690 | 740 |
| Cu—20Ni—10Mn | 70 | 20 | — | 10 | — | — | — | ~1100 | |
| Macrofil 56 | 56 | — | 43 | — | — | 1 | — | 866 | 888 |
| Macrofil 65 | 65 | 15 | 20 | — | — | — | — | 1040 | 1075 |
| Macrofil 49 | 49 | 10 | 41 | — | — | — | — | 921 | 935 |
| C96800 | 81.8 | 10 | — | — | — | 8 | 0.2 | 1050 | 1150 |
| Cu—20Ni—20Mn | 60 | 20 | — | 20 | — | — | — | 1030 | 1050 |
| Cu—25Ni—25Mn | 50 | 25 | — | 25 | — | — | — | 1030 | 1050 |

By mentioning specific infiltrant alloys in Table 1, applicant does not intend to limit the scope of the invention to infiltrant alloys with these specific compositions and/or properties. As one alternative, the composition of the infiltrant alloy could be within the range of 5-40 weight percent nickel, 5-40 weight percent manganese and the balance copper.

Referring to a hard component-matrix composite material, the hard particles in the hard composite may comprise 100 percent crushed nickel cemented chromium carbide particles. The nickel could comprise between about 3 weight percent and about 25 weight percent of the cemented carbide with chromium carbide comprising the balance. The preferred composition of the cemented carbide is about 15 weight percent nickel and the balance chromium carbide. The particle size of the crushed cemented (nickel) chromium carbide particles can range between about −325 mesh and about +80 mesh. The infiltrant alloy can comprise between about 60 weight percent and about 80 weight percent of the hard composite and the crushed nickel cemented chromium carbides can comprise between about 20 weight percent and about 40 weight percent of the hard composite.

Referring to another hard component-matrix composite material, it can also be made from the compositions set forth in Table 1A below. The matrix powder is Mixture No. 2 taken from Table 2 hereof. The hard constituents are crushed nickel cemented chromium carbide wherein the nickel is present in an amount of 15 weight percent. The particle size of the crushed cemented (nickel) chromium carbide particles can range between about −325 mesh and about +80 mesh. The titanium diboride ($TiB_2$) particles have a particle size equal to −325 mesh. The infiltrant alloy was the copper-based alloy A-1 set forth in Table 1. The infiltrant alloy comprised between about 60 weight percent and about 70 weight percent of the hard composite.

TABLE 2A

Compositions of the Hard Composite

| Composition | Matrix Powder Mixture No. 2 from Table 2 hereof (weight percent) | Crushed Nickel Cemented Chromium Carbide (−325 + 80 mesh) (weight percent) | Titanium Diboride Particles (−325 mesh) (weight percent) |
|---|---|---|---|
| 1-A | 40 | 40 | 20 |
| 2-A | 80 | | 20 |
| 3-A | 66 | | 34 |
| 4-A | | 66 | 34 |
| 5-A | | 50 | 50 |

In yet another embodiment of the hard constituent-matrix composite, there are a plurality of sintered cemented carbide members that typically have a composition of 10 weight percent cobalt and the balance tungsten carbide. The matrix powder typically includes tungsten carbide, chromium carbide, as well as cobalt and nickel in the form of a binder alloy for the carbides and/or a coating on the carbides. One typical infiltrant alloy has a composition (weight percent) of copper (53%)-nickel(15%)-manganese(24%)-zinc(8%) and a melting point equal to about 1150 degrees Centigrade.

In certain embodiments, the cemented carbide members, which for example take on a drop-like shape, typically cover between about 40 percent to about 60 percent of the surface area of the hard composite. The cemented carbide members generally comprise about 90 weight percent of the hard composite 52. In the case where the cemented carbide members take on a square or rectangular shape, the members can cover up to between about 80 percent and about 85 percent of the surface area of the hard composite.

Another composition for the hard constituent-matrix composite material comprises hard constituents that comprise one or more sintered carbides wherein these carbides include tungsten, titanium, niobium, tantalum, hafnium, chromium and zirconium. The matrix powder typically comprises one or more sintered carbides, crushed sintered carbides, cast carbide, crushed carbides, tungsten carbide powders and chromium carbide powders. The infiltrant alloy has a composition (weight percent) of copper(53%)-nickel(15%)-manganese (24%)-zinc(8%) and a melting point equal to about 1150 degrees Centigrade.

In still another composition, the hard constituents that comprise crushed cemented tungsten carbide having a particle size equal to −80+120 mesh. The cemented carbide is cobalt cemented tungsten carbide where the cobalt is present in an amount of 10 weight percent. The hard composite further contains a matrix powder that could be any one of the matrix powders set forth in Table 2 through Table 6 hereof, but preferred a matrix powder may be any one of Matrix Powders Nos. 1 through 3 set forth in Table 2 a hereof. The ratio by weight of the matrix powder to the infiltrant alloy is about 40:60 by weight. In some applications, the hard constituent crushed cemented tungsten carbide particles (−80+120 mesh) range between about 2.5 volume percent and about 40 volume percent of the hard composite with the balance comprising matrix powder and infiltrant alloy. However, there are some applications in which the crushed cemented tungsten carbide particles range between about 2 volume percent to about 4 volume percent of the hard composite. There are also other applications in which the crushed cemented tungsten carbide particles range between about 30 volume percent and about 40 volume percent of the hard composite.

In yet another embodiment, the hard constituents may comprise one or more sintered carbides wherein these carbides include tungsten, titanium, niobium, tantalum, hafnium, chromium and zirconium. The matrix powder typically comprises one or more sintered carbides, crushed sintered carbides, cast carbide, crushed carbides, tungsten carbide powders and chromium carbide powders. The infiltrant alloy has a composition of copper(53%)-nickel(15%)-manganese(24%)-zinc(8%) and a melting point equal to about 1150 degrees Centigrade.

The hard constituent-matrix composite material can comprise crushed cemented tungsten carbide having a particle size equal to −80+120 mesh. The cemented carbide is cobalt cemented tungsten carbide where the cobalt is present in an amount of 10 weight percent. The hard composite further contains a matrix powder that could be any one of the matrix powders set forth in Table 2 through Table 6 hereof, but preferred a matrix powder may be any one of Matrix Powders Nos. 1 through 3 set forth in Table 2 hereof. The ratio by weight of the matrix powder to the infiltrant alloy is about 40:60 by weight. In some applications, the hard constituent crushed cemented tungsten carbide particles (−80+120 mesh) range between about 2.5 volume percent and about 40 volume percent of the hard composite with the balance comprising matrix powder and infiltrant alloy. However, there are some applications in which the crushed cemented tungsten carbide particles range between about 2 volume percent to about 4 volume percent of the hard composite. There are also other applications in which the crushed cemented tungsten carbide particles range between about 30 volume percent and about 40 volume percent of the hard composite.

In some embodiments, the hard constituents can also comprise cemented carbides, silicon carbides, boron carbide, aluminum oxide, zirconia and other suitable hard materials. The matrix powder typically comprises one or more of crushed tungsten carbide, crushed cemented tungsten carbide, crushed cast tungsten carbide, iron powder, tungsten carbide powder (the tungsten carbide made by a thermit process or from co-carburized tungsten carbide), chromium carbide powder, spherical cast carbide powder and/or spherical sintered carbide powders. The infiltrant alloy has a composition of copper(53%)-nickel(15%)-manganese(24%)-zinc(8%) and a melting point equal to about 1150 degrees Centigrade.

Examples of specific matrix powders (Mixtures Nos. 1 through 20) are set forth in Tables 2 through 6 hereinafter. In reference to the composition of the matrix powders, it should be appreciated that the crushed tungsten carbide component or the crushed cast tungsten carbide component may be substituted, in whole or in part, by spherical sintered tungsten carbide and/or spherical cast tungsten carbide particles. In some cases the spherical sintered tungsten carbide and/or spherical cast carbide particles (or powders) could be used 100% in combination or alone as the hard constituents in the matrix powders.

TABLE 2

Components of the Matrix Powder Mixtures Nos. 1 through 4 (Weight Percent)

| Constituent (particle size) | Mixture No. 1 | Mixture No. 2 | Mixture No. 3 | Mixture No. 4 |
|---|---|---|---|---|
| Crushed tungsten carbide (−80 + 325 mesh) | 67 wt. % | 67 wt. % | 0 wt. % | 0 wt. % |

TABLE 2-continued

Components of the Matrix Powder Mixtures Nos. 1 through 4 (Weight Percent)

| Constituent (particle size) | Mixture No. 1 | Mixture No. 2 | Mixture No. 3 | Mixture No. 4 |
|---|---|---|---|---|
| Crushed tungsten carbide (−325 mesh) | 0 wt. % | 15.5 wt. % | 0 wt. % | 0 wt. % |
| Crushed cast tungsten carbide (−325 mesh) | 31 wt. % | 15.5 wt. % | 0 wt. % | 0 wt. % |
| 4600 steel (−325 mesh) | 1 wt. % | 0 wt. % | 0 wt. % | 0 wt. % |
| Carbonyl iron (−325 mesh) | 1 wt. % | 0 wt. % | 0 wt. % | 0 wt. % |
| Nickel (−325 mesh) | 0 wt. % | 2 wt. % | 0 wt. % | 0 wt. % |
| Crushed cobalt (10 wt. Percent) cemented tungsten carbide (−140 + 325 mesh) | 0 wt. % | 0 wt. % | 100 wt. % | |
| Crushed nickel (10 wt. Percent) cemented tungsten carbide (−140 + 325 mesh) | 0 wt. % | 0 wt. % | | 100 wt. % |

TABLE 3

Components of the Matrix Powder Mixtures Nos. 5 through 8 (Weight Percent)

| Constituent (particle size) | Mixture No. 5 | Mixture No. 6 | Mixture No. 7 | Mixture No. 8 |
|---|---|---|---|---|
| Crushed tungsten carbide (−80 + 325 mesh) | 63.65 wt. % | 63.65 wt. % | 0 wt. % | 0 wt. % |
| Crushed tungsten carbide (−325 mesh) | 0 wt. % | 14.725 wt. % | 0 wt. % | 0 wt. % |
| Crushed cast tungsten carbide (−325 mesh) | 29.45 wt. % | 14.725 wt. % | 0 wt. % | 0 wt. % |
| 4600 steel (−325 mesh) | .95 wt. % | 0 wt. % | 0 wt. % | 0 wt. % |
| Carbonyl iron (−325 mesh) | .95 wt. % | 0 wt. % | 0 wt. % | 0 wt. % |
| Nickel (−325 mesh) | 0 wt. % | 1.9 wt. % | 0 wt. % | 0 wt. % |
| Crushed cobalt (10 wt. Percent) cemented tungsten carbide (−140 + 325 mesh) | 0 wt. % | 0 wt. % | 95 wt. % | |
| Crushed nickel (10 wt. Percent) cemented tungsten carbide (−140 + 325 mesh) | 0 wt. % | 0 wt. % | | 95 wt. % |
| Chromium carbide (−45 mesh) | 5 wt. % | 5 wt. % | 5 wt. % | 5 wt. % |

TABLE 4

Components of the Matrix Powder Mixtures Nos. 9 through 12 (Weight Percent)

| Constituent (particle size) | Mixture No. 9 | Mixture No. 10 | Mixture No. 11 | Mixture No. 12 |
|---|---|---|---|---|
| Crushed tungsten carbide (−80 + 325 mesh) | 53.6 wt. % | 53.6 wt. % | 0 wt. % | 0 wt. % |
| Crushed tungsten carbide (−325 mesh) | 0 wt. % | 12.4 wt. % | 0 wt. % | 0 wt. % |
| Crushed cast tungsten carbide (−325 mesh) | 24.8 wt. % | 12.4 wt. % | 0 wt. % | 0 wt. % |
| 4600 steel (−325 mesh) | .8 wt. % | 0 wt. % | 0 wt. % | 0 wt. % |
| Carbonyl iron (−325 mesh) | .8 wt. % | 0 wt. % | 0 wt. % | 0 wt. % |
| Nickel (−325 mesh) | 0 wt. % | 1.6 wt. % | 0 wt. % | 0 wt. % |
| Crushed cobalt (10 wt. Percent) cemented tungsten carbide (−140 + 325 mesh) | 0 wt. % | 0 wt. % | 80 wt. % | |
| Crushed nickel (10 wt. Percent) cemented tungsten carbide (−140 + 325 mesh) | 0 wt. % | 0 wt. % | 0 wt. % | 80 wt. % |
| Nickel Coated Tungsten Carbide Powder (−325 mesh) | 20 wt. % | 20 wt. % | 20 wt. % | 20 wt. % |

TABLE 5

Components of Matrix Powder Mixtures 13 through 16 (Weight Percent)

| Constituent (particle size) | Mixture No. 13 | Mixture No. 14 | Mixture No. 15 | Mixture No. 16 |
|---|---|---|---|---|
| Crushed tungsten carbide (−80 + 325 mesh) | 60.3 wt. % | 60.3 wt. % | 0 wt. % | 0 wt. % |
| Crushed tungsten carbide (−325 mesh) | 0 wt. % | 13.95 wt. % | 0 wt. % | 0 wt. % |
| Crushed cast tungsten carbide (−325 mesh) | 27.9 wt. % | 13.95 wt. % | 0 wt. % | 0 wt. % |
| 4600 steel (−325 mesh) | .9 wt. % | 0 wt. % | 0 wt. % | 0 wt. % |
| Carbonyl iron (−325 mesh) | .9 wt. % | 0 wt. % | 0 wt. % | 0 wt. % |
| Nickel (−325 mesh) | 0 wt. % | 1.8 wt. % | 0 wt. % | 0 wt. % |
| Crushed cobalt (10 wt. Percent) cemented tungsten carbide (−140 + 325 mesh) | 0 wt. % | 0 wt. % | 90 wt. % | |
| Crushed nickel (10 wt. Percent) cemented tungsten carbide (−140 + 325 mesh) | 0 wt. % | 0 wt. % | 0 wt. % | 90 wt. % |
| Crushed nickel (15 wt %) cemented chromium carbide(Ni—$Cr_3C_2$) (−140 + 325 mesh) | 10 wt. % | 10 wt. % | 10 wt. % | 10 wt. % |

TABLE 6

Components of Matrix Powder Mixtures 17 through 20 (in Weight Percent)

| Constituent (particle size) | Mixture No. 17 | Mixture No. 18 | Mixture No. 19 | Mixture No. 20 |
|---|---|---|---|---|
| ed tungsten carbide (−80 + 325 mesh) | 56.95 wt. % | 56.95 wt. % | 0 wt. % | 0 wt. % |
| Crushed tungsten carbide (−325 mesh) | 0 wt. % | 13.175 wt. % | 0 wt. % | 0 wt. % |
| Crushed cast tungsten carbide (−325 mesh) | 26.35 wt. % | 13.175 wt. % | 0 wt. % | 0 wt. % |
| 4600 steel (−325 mesh) | .85 wt. % | 0 wt. % | 0 wt. % | 0 wt. % |
| Carbonyl iron (−325 mesh) | .85 wt. % | 0 wt. % | 0 wt. % | 0 wt. % |
| Nickel (−325 mesh) | 0 wt. % | 1.7 wt. % | 0 wt. % | 0 wt. % |
| Crushed cobalt (10 wt. Percent) cemented tungsten carbide (−140 + 325 mesh) | 0 wt. % | 0 wt. % | 85 wt. % | |
| Crushed nickel (10 wt. Percent) cemented tungsten carbide (−140 + 325 mesh) | 0 wt. % | 0 wt. % | | 85 wt. % |
| Nickel-coated tungsten carbide −325 mesh) | 15 wt. % | 15 wt. % | 15 wt. % | 15 wt. % |

Additional examples of the hard constituent-matrix composite material are set forth hereinafter. One such example of the hard constituent-matrix composite material comprises sintered cobalt (10 weight percent cobalt) cemented tungsten carbide members and the matrix powder comprised Mixture No. 1 in Table 1 and the infiltrant alloy comprised (in weight percent) a Cu(53%)-Ni(15%)-Zn(8%)-Mn(24%) alloy described above. The matrix powder comprised 40 weight percent and the infiltrant alloy comprised 60 weight percent of the combination of the matrix powder and the infiltrant alloy. Depending upon the specific application, the cemented tungsten carbide members were present in a specified amount between about 1 weight percent and about 95 weight percent with the balance of the hard composite comprising the matrix powder and the infiltrant alloy. In the alternative and depending upon the specific application, the cemented tungsten carbide members were present in a specified amount between about 1 weight percent and about 90 percent of the surface area of the hard composite. For some applications, the cemented tungsten carbide members may be present in a range between about 1 percent to about 5 percent of the surface area. For other applications, the cemented tungsten carbide members may be present in a range between about 70 percent and about 90 percent of the surface area.

For yet another example of the hard constituent-matrix composite material, it comprised a sintered cobalt (6 weight percent cobalt) cemented tungsten carbide member. The matrix powder comprised Mixture No. 2. The infiltrant alloy comprised in weight percent) a Cu(53%)-Ni(15%)-Zn(8%)-Mn(24%). The matrix powder comprised 45 weight percent and the infiltrant alloy comprised 55 weight percent of the combination of the matrix powder and the infiltrant alloy. Depending upon the specific application, the cemented tungsten carbide members were present in a specified amount between about 1 weight percent and about 95 weight percent with the balance of the hard composite comprising the matrix powder and the infiltrant alloy. In the alternative and depending upon the specific application, the cemented tungsten carbide members were present in a specified amount between about 1 weight percent and about 90 percent of the surface area of the hard composite. For some applications, the cemented tungsten carbide members may be present in a range between about 1 percent to about 5 percent of the surface area. For other applications, the cemented tungsten carbide members may be present in a range between about 70 percent and about 90 percent of the surface area.

Still another example of the hard constituent-matrix composite material is a composition that comprises sintered cobalt (6 weight percent cobalt) cemented tungsten carbide cylindrical members. The matrix powder was Mixture No. 3 as set forth in Table 1. The infiltrant alloy comprised (in weight percent) a Cu(53%)-Ni(15%)-Zn(8%)-Mn(24%). The matrix powder comprised 40 weight percent and the infiltrant alloy comprised 60 weight percent of the combination of the matrix powder and the infiltrant alloy. Depending upon the specific application, the cemented tungsten carbide members were present in a specified amount between about 1 weight percent and about 95 weight percent with the balance of the hard composite comprising the matrix powder and the infiltrant alloy. In the alternative and depending upon the specific application, the cemented tungsten carbide members were present in a specified amount between about 1 weight percent and about 90 percent of the surface area of the hard composite. For some applications, the cemented tungsten carbide s may be present in a range between about 1 percent to about 5 percent of the surface area. For other applications, the cemented tungsten carbide members may be present in a range between about 70 percent and about 90 percent of the surface area.

Another example of the hard constituent-matrix composite material comprises nickel-coated sintered cobalt (10 weight percent cobalt) cemented tungsten carbide members. The matrix powder comprised Mixture No. 4 from Table 1. The infiltrant alloy comprised (in weight percent) a Cu(53%)-Ni (15%)-Zn(8%)-Mn(24%). The matrix powder comprised 45 weight percent and the infiltrant alloy comprised 55 weight percent of the combination of the matrix powder and the infiltrant alloy. Depending upon the specific application, the cemented tungsten carbide members were present in a specified amount between about 1 weight percent and about 95 weight percent with the balance of the hard composite comprising the matrix powder and the infiltrant alloy. In the alternative and depending upon the specific application, the cemented tungsten carbide members were present in a specified amount between about 1 weight percent and about 90 percent of the surface area of the hard composite. For some applications, the cemented tungsten carbide members may be present in a range between about 1 percent to about 5 percent of the surface area. For other applications, the cemented tungsten carbide members may be present in a range between about 70 percent and about 90 percent of the surface area.

It should be appreciated that the composition and microstructure of the hard composite material can impact the properties useful to the performance of the blade in a drilling or cutting application. Like for the cemented carbides and the steels, the hardness, toughness, erosion resistance and abrasion resistance are properties of the steel that impact upon the performance of the blade during use. As can also be appreciated, there are many variations for the composition and microstructure of the hard composite material so that the portions of the blades made from the hard composite material can exhibit a wide variety of properties to accommodate a wide variety of drilling or cutting applications.

In regard to the method of making the blades with multiple portions, as one alternative, the portions may be first made via a powder metallurgical technique such as, for example, sintering to form fully dense sintered portions, Then, these portions may be joined together via a suitable technique such as, for example, brazing to form the blade member.

Figure 8:
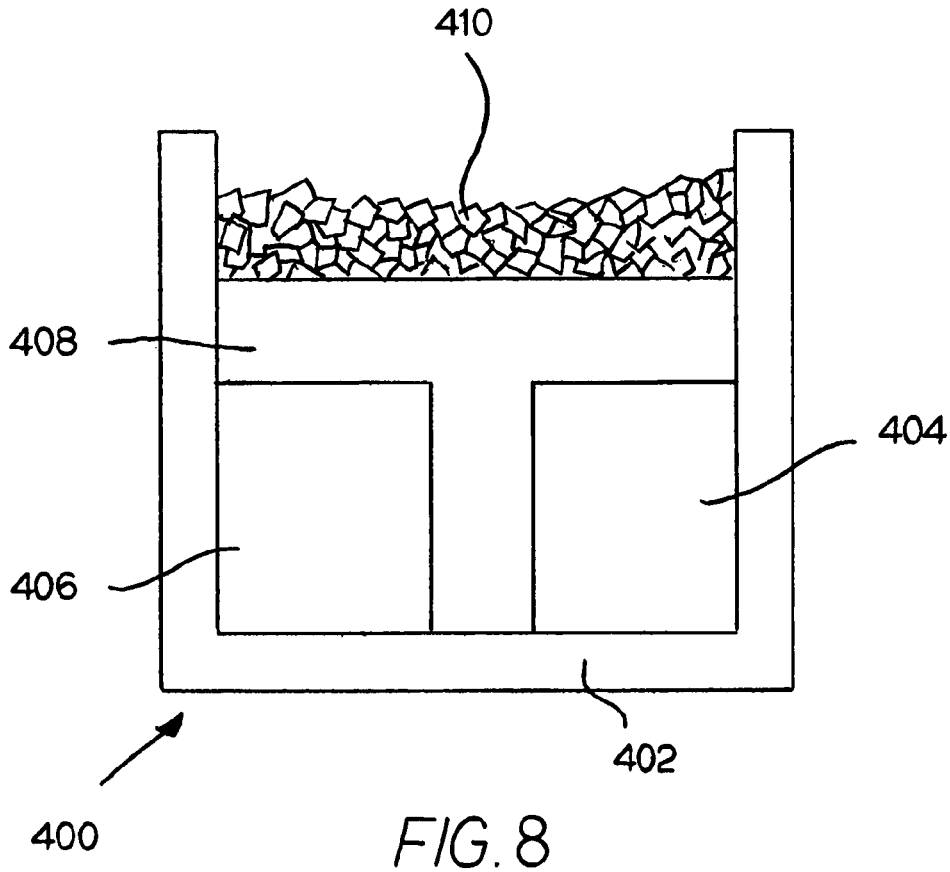
FIG. 8 is a mechanical schematic view that shows the assembly associated with the graphite mold uses to make a blade of the invention.

As another alternative, there is provided a mold of the geometry of the blade. Powders of the various portions are positioned within the mold in pre-elected positions. The powder composite is then consolidated under heat and optionally pressure to form the blade. As one option in this alternative, one or more of the portions could be a fully dense portion and one or more of the portions could be in powder form. In the case where one of the portions is the hard constituent-matrix composite material, the hard constituents and matrix could be infiltrated with the infiltrant as described in U.S. Pat. No. 6,984,454 to Majagi. FIG. 8 illustrates a method along the lines of the above alternative.

In FIG. 8, there is illustrated in a mechanical schematic form the production assembly generally designated as 400 associated with a graphite pot used to make the blades. The assembly 400 comprises a graphite pot 402 that contains a volume. In the volume of the graphite pot 402, there is positioned a steel member (or portion of the blade) 404 and a cemented (cobalt) tungsten carbide member (or portion of the blade) 406. A mass of matrix powder 408 is positioned both between and on top of the steel member 404 and the cemented (cobalt) tungsten carbide member 406. A layer of infiltrant alloy 410 is positioned on the top of the mass of matrix powders 408. The assembly is heated so that the infiltrant alloy melts and passes through the matrix powders and into contact with the steel member and the cemented (cobalt) tungsten carbide member. The end result is the formation of the blade that comprises the cemented (cobalt) tungsten carbide portion, the steel portion and the matrix portion.

As another alternative to the above method, the blades or least some portion(s) of the blades may not be essentially fully dense, but can be in powder form. In such a case, the powder(s) for the blade portion(s) are positioned in the mold and the various powders and any other components are also positioned within the mold. The contents of the mold are heated so as to consolidate all of the powder components (including any of the portions of the blades) whereby the blades are metallurgically joined to the cutter bit body.

A further embodiment of the invention is a method of producing an earth-boring bit, comprising casting the earth-boring bit from a molten mixture of at least one of iron, nickel, and cobalt and a carbide of a transition metal. The mixture may be a eutectic or near eutectic mixture. In these embodiments, the blades are positioned in the mold and the earth-boring bit may be cast directly to metallurgically bond the blade to the cutter bit body.

As can be appreciated, the present invention provides an improved blade, which carries cutter elements, that is affixed or attached to a tool or bit body. The tool or bit (e.g., fixed cutter bit) is useful in applications that involve impingement of the earth strata (e.g., downhole drilling, mining applications, road planning applications, concrete cutting applications, and the like). The improved blade increases the overall tool life of the tool or bit by the use of materials with improved combinations of strength, toughness, abrasion wear resistance and/or erosion wear resistance.

More specifically, tools or bits used in drilling boreholes in subterranean formations experience (or can experience) a significant amount of abrasive wear during the drilling operation due to the abrasive nature of a typical earth formation. Tools or bits used in other applications that impinge the earth strata (e.g., mining applications, road planning applications, concrete cutting applications, and the like) also experience a significant amount of abrasive wear during use. It is now apparent that the present invention provides an improved blade, which carries cutter elements, affixed or attached to a tool or bit body wherein the blade as well as the tool or bit exhibit improved abrasive wear resistance.

More specifically, tools or bits used in drilling boreholes in subterranean formations experience (or can experience) a significant amount of impact during the drilling operation due to the abrasive nature of a typical earth formation. Tools or bits used in other applications that impinge the earth strata (e.g., mining applications, road planning applications, concrete cutting applications, and the like) also experience a significant amount of impact during use. It is now apparent that the present invention provides an improved blade, which carries cutter elements, affixed or attached to a tool or bit body wherein the blade as well as the tool or bit exhibit improved impact resistance.

More specifically, tools or bits used in drilling boreholes in subterranean formations experience (or can experience) a significant amount of erosive wear during the drilling operation due to the abrasive nature of a typical earth formation. Such erosive wear can be exacerbated by fluid emitted from the nozzles in the bit body that directly impinges upon the tool or bit body, as well as the blades that carry the cutter elements. Tools or bits used in other applications that impinge the earth strata (e.g., mining applications, road planning applications, concrete cutting applications, and the like) also experience a significant amount of erosive wear during use. It is now apparent that the present invention provides an improved blade, which carries cutter elements, affixed or attached to a tool or bit body wherein the blade as well as the tool or bit exhibit improved erosive wear resistance.

All patents, patent applications, articles and other documents identified herein are hereby incorporated by reference herein. Other embodiments of the invention may be apparent to those skilled in the art from a consideration of the specification or the practice of the invention disclosed herein. It is intended that the specification and any examples set forth herein be considered as illustrative only, with the true spirit and scope of the invention being indicated by the following claims.

What is claimed is:

1. A blade for use on a fixed cutter bit that impinges earth strata in a drilling operation, the blade comprising:

a blade body having a leading surface;

the blade body having a distinct first piece defining substantially all of the leading surface, the distinct first piece containing at least one groove for receiving a cutter element, and the blade body further having a distinct second piece and the distinct second piece being a trailing portion;

the distinct first piece comprising a first material composition and the distinct second piece comprising a second material composition;

the groove being oriented such that the cutter element when received within the groove extends rotationally forward of the leading surface; and wherein the distinct first piece being detachably joined to the distinct second piece.

2. The blade of claim 1 wherein the first material composition and the second material composition being a same kind of material but of a different composition.

3. The blade of claim 1 wherein the first material composition being of a different kind of material from the second material composition.

4. The blade of claim 1 wherein the first material composition comprising a material selected from the group consisting of (A) cemented carbide and (B) a hard composite comprising a plurality of discrete hard constituents and matrix powder of hard particles and an infiltrant alloy bonded together to form the hard composite; wherein each one of the discrete hard constituents is of a size so as to have a surface area between about 0.006 square centimeters and about 1452 square centimeters, wherein substantially all of the hard particles have a size smaller than the size of the hard constituents, and the infiltrant alloy having a melting point between about 500 degrees Centigrade and about 1400 degrees Centigrade;

wherein the matrix powder is selected from the group consisting of one or more of the following:

(A) spherical cast carbides, (B)spherical sintered carbides, (C) crushed cemented carbide particles, (D) crushed cast carbide particles, (E) crushed carbide particles, (F) cemented carbide powder, (G) steel particles, (H) carbonyl iron particles, and (I) coated carbide particles;

wherein the discrete hard constituents are selected from the group consisting of one or more of (A) cemented carbides; (B) ceramics; (C) sintered cemented tungsten carbide wherein a binder includes one or more of cobalt, nickel, iron and molybdenum; (D) coated sintered cemented tungsten carbide wherein a binder includes one or more of cobalt, nickel, iron and molybdenum, and the coating comprises one or more of nickel, cobalt, iron and molybdenum;

(E) one or more of the carbides, nitrides, and borides of one or more of titanium, niobium, tantalum, hafnium, and zirconium; (F) tungsten carbide; (G) one or more of the coated carbides, coated nitrides, and coated borides of one or more of titanium, niobium, tantalum, hafnium, and zirconium wherein the coating comprises one or more of nickel, cobalt, iron and molybdenum;

(H) coated tungsten carbide wherein the coating comprises one or more of nickel, cobalt, iron and molybdenum; (I) coated silicon carbide wherein the coating comprises one or more of nickel, cobalt, iron and molybdenum; (J) coated silicon nitride wherein the coating comprises one or more of nickel, cobalt, iron and molybdenum; and (K) coated boron carbide; and the second material composition comprising a material selected from the group consisting of (A) cemented carbide; (B) a hard composite comprising a plurality of discrete hard constituents and matrix powder of hard particles and an infiltrant alloy bonded together to form the hard composite; wherein each one of the discrete hard constituents is of a size so as to have a surface area between about 0.006 square centimeters and about 1452 square centimeters, wherein substantially all of the hard particles have a size smaller than the size of the hard constituents, and the infiltrant alloy having a melting point between about 500 degrees Centigrade and about 1400 degrees Centigrade; wherein the matrix powder is selected from the group consisting of one or more of the following: (A) spherical cast carbides, (B) spherical sintered carbides, (C) crushed cemented carbide particles, (D) crushed cast carbide particles, (E) crushed carbide particles, (F) cemented carbide powder, (G) steel particles, (H) carbonyl iron particles, and (I) coated carbide particles; wherein the discrete hard constituents are selected from the group consisting of one or more of (A) cemented carbides; (B) ceramics; (C) sintered cemented tungsten carbide wherein a binder includes one or more of cobalt, nickel, iron and molybdenum; (D) coated sintered cemented tungsten carbide wherein a binder includes one or more of cobalt, nickel, iron and molybdenum, and the coating comprises one or more of nickel, cobalt, iron and molybdenum; (E) one or more of the carbides, nitrides, and borides of one or more of titanium, niobium, tantalum, hafnium, and zirconium; (F) tungsten carbide; (G) one or more of the coated carbides, coated nitrides, and coated borides of one or more of titanium, niobium, tantalum, hafnium, and zirconium wherein the coating comprises one or more of nickel, cobalt, iron and molybdenum; (H) coated tungsten carbide wherein the coating comprises one or more of nickel, cobalt, iron and molybdenum; (I) coated silicon carbide wherein the coating comprises one or more of nickel, cobalt, iron and molybdenum; (J) coated silicon nitride wherein the coating comprises one or more of nickel, cobalt, iron and molybdenum; and (K) coated boron carbide.

5. The blade of claim 4 wherein the infiltrant alloy is selected from the group consisting of any one of the following alloys: (A) between about 15 weight percent and about 75 weight percent copper, between about 1 weight percent and about 70 weight percent nickel, between about 1 weight percent and about 45 weight percent manganese; (B) between about 40 weight percent and about 80 weight percent copper, between about 15 weight percent and about 30 weight percent nickel, and between about 5 weight percent and about 30 weight percent manganese; (C) between about 15 weight percent and about 50 weight percent copper, between about 5 weight percent and about 45 weight percent zinc, and between about 15 weight percent and about 75 weight percent silver; (D) between about 75 weight percent and about 85 weight percent copper, between about 5 weight percent and about 15 weight percent nickel, between about 5 weight percent and about 15 weight percent tin, and greater than or equal to about 0.1 weight percent niobium; (E) between about 15 weight percent and about 50 weight percent zinc and between about 45 weight percent and about 65 weight percent copper; and (F) between about 15 weight percent and about 50 weight percent zinc and between about 45 weight percent and about 65 weight percent copper, and about 5 weight percent and about 20 weight percent nickel.

6. The blade of claim 1 further including a mechanical fastener to detachably join the distinct first piece and the distinct second piece.

7. A blade for use on a fixed cutter bit that impinges earth strata in a drilling operation, the blade comprising:

a blade body having a leading surface;

the blade body having a distinct first piece defining substantially all of the leading surface, the distinct first piece containing at least one groove for receiving a cutter element, and the blade body further having a distinct second piece and the distinct second piece being a trailing portion;

the distinct firstpiece comprising a first material composition and the distinct second piece comprising a second material composition;

the groove being oriented such that the cutter element when received within the groove extends rotationally forward of the leading surface;

wherein the blade body further comprising a distinct mediate piece positioned mediate of the distinct first piece and the distinct second piece, and the distinct mediate piece being made from a third material composition selected from the group consisting of (A) cemented carbide, (B) steel and (C) a hard composite comprising a plurality of hard constituents and matrix powder of hard particles and an infiltrant alloy bonded together to form the hard composite; and wherein the distinct first piece being detachably joined to the distinct mediate piece and the distinct second piece being detachably joined to the distinct mediate piece.

8. The blade of claim 7 wherein the first material composition and the third material composition being of the same kind of material but of a different composition.

9. The blade of claim 7 wherein the first material composition being of a different kind of material from the third material composition.

10. The blade of claim 7 further including a mechanical fastener to detachably join the distinct first piece and the distinct second piece and the distinct mediate piece.

* * * * *